US012662714B2

(12) United States Patent
Jansone-Popova et al.

(10) Patent No.: US 12,662,714 B2
(45) Date of Patent: Jun. 23, 2026

(54) METHOD FOR SEPARATION OF ADJACENT LANTHANIDE ELEMENTS

(71) Applicant: UT-Battelle, LLC, Oak Ridge, TN (US)

(72) Inventors: Santa Jansone-Popova, Knoxville, TN (US); Ilja Popovs, Knoxville, TN (US); Katherine R. Johnson, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 489 days.

(21) Appl. No.: 18/195,099

(22) Filed: May 9, 2023

(65) Prior Publication Data

US 2023/0366059 A1 Nov. 16, 2023

Related U.S. Application Data

(60) Provisional application No. 63/339,996, filed on May 10, 2022.

(51) Int. Cl.

| | |
|---|---|
| ***C07D 471/22*** | (2006.01) |
| ***C22B 3/36*** | (2006.01) |
| ***C22B 59/00*** | (2006.01) |

(52) U.S. Cl.
CPC ..... *C22B 3/362* (2021.05); *C22B 59/00* (2013.01)

(58) Field of Classification Search
CPC ..... C07D 471/22; C22B 3/362; C22B 59/00
USPC ..... 546/48
See application file for complete search history.

(56) References Cited

U.S. PATENT DOCUMENTS

2022/0000229 A1 1/2022 Sapir
2022/0002840 A1 1/2022 Jansone-Popova et al.

OTHER PUBLICATIONS

Chen, Z., et al., "Extraction and complexation of trivalent rare earth elements with tetraalkyl diglycolamides", Inorganica Chimica Acta, Dec. 1, 2020, Received in revised form Jul. 16, 2020; Accepted Jul. 23, 2020, Available online Jul. 26, 2020, pp. 11 pages, 119928, vol. 513.

Florek, J., Selective Recovery of Rare Earth Elements Using Chelating Ligands Grafted on Mesoporous Surfaces, RSC Adv., 2015, Accepted Nov. 23, 2015, pp. 103782-103789, 5.

Ibrahim, S.M., et al., "Selective Extraction of Light Lanthanides(III) by N,N Di(2-ethylhexyl)-diglycolamic Acid: A Comparative Study with N,N Dimethyl-diglycolamic Acid as a Chelator in Aqueous Solutions", ACS Omega 2019, Accepted Nov. 14, 2019, Published Nov. 27, 2019, pp. 20797-20806, 4.

Jansone-Popova, S., et al., "Bis-lactam-1,10-phenanthroline (BLPhen), a New Type of Preorganized Mixed N,O-Donor Ligand That Separates Am(III) over Eu(III) with Exceptionally High Efficiency", Inorg. Chem. 2017, Published May 4, 2017, pp. 5911-5917, 56.

Johnson, K.R., et al., "Size Selective Ligand Tug of War Strategy to Separate Rare Earth Elements", JACS Au 2023, Revised Jan. 9, 2023, Accepted Jan. 13, 2023, Published Jan. 25, 2023, pp. 584-591, 3.

Kukkonen, E., et al., "a-Aminophosphonates, -Phosphinates, and -Phosphine Oxides as Extraction and Precipitation Agents for Rare Earth Metals, Thorium, and Uranium: A Review", Molecules 2022, Accepted May 25, 2022, Published May 27, 2022, pp. 1-28, 27, 3465.

Liu, Y., et al., "Extraction and stripping behaviors of 14 lanthanides from nitric acid medium by N,N' dimethyl N, N' dioctyl diglycolamide", Journal of Radioanalytical and Nuclear Chemistry (2020), Published online Jun. 13, 2020, pp. 409-416.

Liu, T., et al., "Advancing Rare-Earth Separation by Machine Learning", JACS Au 2022, Revised May 24, 2022, Accepted Jun. 1, 2022, Published Jun. 15, 2022, pp. 1428-1434, 2.

Macerata, E., et al., "Actinide-lanthanide co-extraction by rigidified diglycolamides", Solvent Extraction and Ion Exchange 2018, Published online Dec. 26, 2017, pp. 41-53, vol. 36, No. 1.

(Continued)

*Primary Examiner* — Charanjit Aulakh
(74) *Attorney, Agent, or Firm* — Scully, Scott, Murphy & Presser, P.C.

(57) ABSTRACT

Lanthanide complexing molecules having the following structure:

(1)

wherein: $R^1$, $R^2$, $R^4$, and $R^5$ are independently selected from hydrogen atom, alkyl groups containing 1-3 carbon atoms, and hydrophilic groups containing at least one oxygen atom; $R^3$ and $R^6$ are independently selected from hydrogen atom, alkyl groups containing 1-3 carbon atoms, and hydrophilic groups containing at least one oxygen atom; and $R^a$ and $R^b$ are independently selected from hydrogen atom, methyl group, halogen atoms, and hydrophilic groups containing at least one oxygen atom; wherein at least two of $R^1$, $R^2$, $R^3$, $R^4$, $R^5$, $R^6$, $R^a$, and $R^b$ are said hydrophilic groups. Also described is a method of separating adjacent lanthanides by use of a two-phase extractant system that includes (i) an acidic aqueous solution containing the lanthanide complexing molecule (1) along with a mixture of at least two lanthanides, and (ii) an aqueous-insoluble hydrophobic solution containing a lipophilic lanthanide extractant compound.

27 Claims, 5 Drawing Sheets

(56) References Cited

OTHER PUBLICATIONS

Matsutani, T., et al., "Separation of Light and Middle Lanthanides Using Multistage Extraction with Diglycolamide Extractant", Analytical Sciences 2021, Published Nov. 10, 2021, pp. 1603-1609, 37.
Mowafy, E.A., "Extraction Behaviors of Critical Rare Earth Elements with Novel Structurally Tailored Unsymmetrical Diglycolamides from Acidic Media", Extraction and Ion Exchange 2022, Published online May 17, 2021, pp. 387-411, vol. 40, No. 4.
Nilsson, M., et al., "Trans-Lanthanide Extraction Studies in the TALSPEAK System: Investigating the Effect of Acidity and Temperature", Solvent Extraction and Ion Exchange, 2009, pp. 354-377, 27.
Nishihama, S., et al., "Selective Extraction of Y from a Ho/Y/Er Mixture by Liquid-Liquid Extraction in the Presence of a Water-Soluble Complexing Agent", Ind. Eng. Chem. Res. 2000, Published on Web Sep. 8, 2000, pp. 3907-3911, vol. 39, No. 10.
Nomizu, D., et al., "Complex formation of light and heavy lanthanides with DGA and DOODA, and its application to mutual separation in DGA-DOODA extraction system", Journal of Radioanalytical and Nuclear Chemistry (2022), Accepted Jan. 12, 2022, Published online Feb. 3, 2022, pp. 1483-1493, 331.
O'Driscoll, L.J., et al., "Reversible Thermal Switching of Aqueous Dispersibility of Multiwalled Carbon Nanotubes", Chem. Eur. J. 2015, Published online Jan. 29, 2015, pp. 3891-3894, 21.
Persson, I., et al., "Hydration of LanthanoidACHTUNGTRENUNG(III) Ions in Aqueous Solution and Crystalline Hydrates Studied by EXAFS Spectroscopy and Crystallography: The Myth of the "Gadolinium Break"", Chem. Eur. J. 2008, Published online Feb. 18, 2008, pp. 3056-3066, 14.
Ravel, B., et al., "Athena, Artemis, Hephaestus: data analysis for X-ray absorption spectroscopy using IFEFFIT", Journal of Synchrotron Radiation (2005), Accepted Apr. 21, 2005, pp. 537-541, 12.
Sasaki, Y., et al., "Novel Soft-Hard Donor Ligand, NTAamide, for Mutual Separation of Trivalent Actinoids and Lanthanoids", Chem. Lett. 2013, Published online Jan. 5, 2013, pp. 91-92, 42.
Stamberga, D., et al., "Structure Activity Relationship Approach toward the Improved Separation of Rare-Earth Elements Using Diglycolamides", Inorg. Chem. 2020, Published Nov. 13, 2020, pp. 17620-17630, 59.
Sun, X., et al., "The optimization of an ionic liquid-based TALSPEAK-like process for rare earth ions separation", Chemical Engineering Journal (2014), Received in revised form Oct. 10, 2013, Accepted Nov. 20, 2013, Available online Nov. 27, 2013, pp. 392-398, 239.
Yang, N., et al., "Synthesis, characterization of 2-(bis-dibutylcarbamoylmethylamino)-N, N-dibutyl-acetamide (L) lanthanide picrate complexes (Ln ¼ Nd, Eu, Tb) and the crystal structure of [Tb(pic)3L]", Journal of Molecular Structure (2003), revised May 27, 2003, accepted May 30, 2003, pp. 177-183, 657.
Zabinsky, S.I., et al., "Multiple-scattering calculations of x-ray-absorption spectra", Physical Review B, Jul. 15, 1995, pp. 2995-3008, vol. 52, No. 4.

5a

5b

METHOD FOR SEPARATION OF ADJACENT LANTHANIDE ELEMENTS

CROSS REFERENCE TO RELATED APPLICATION

The present application claims benefit of U.S. Provisional Application No. 63/339,996, filed on May 10, 2022, all of the contents of which are incorporated herein by reference.

STATEMENT REGARDING FEDERALLY SPONSORED RESEARCH

This invention was made with government support under Prime Contract No. DE-AC05-00OR22725 awarded by the U.S. Department of Energy. The government has certain rights in the invention.

FIELD OF THE INVENTION

The present invention generally relates to lanthanide-complexing ligands and their use in separating adjacent lanthanide elements. The present invention more particularly relates to phenanthroline derivatives as lanthanide complexing agents and methods of using these derivatives for facilitating the separation of adjacent lanthanide elements.

BACKGROUND OF THE INVENTION

Rare earth elements (REEs) generally include 15 lanthanides (lanthanum-lutetium), scandium, and yttrium. REEs possess unique physical and chemical properties and are integral for a variety of technology applications, including smartphones, wind turbines, and electric vehicles. The Department of Energy (DOE) and European Commission have named REEs as "critical raw materials" based on the challenges associated with their separation and continuous increase in global consumption (Sholl, D. S.; Lively, R. P. Seven chemical separations to change the world, *Nature* 2016, 533, 316-316; Critical Materials Strategy, Report DOE/PI-0009, U.S. Department of Energy, Washington, DC, December 2011). Lack of a domestic supply chain of pure REEs has left the United States and other countries largely dependent on other nations. Moreover, Pthe low minable concentration of REEs in the Earth's crust makes it difficult to economically recover and separate them due to their very similar chemical and physical properties.

Solvent (liquid-liquid) extraction is the industry standard used to separate rare earth elements (REE) from aqueous acidic solutions. Liquid-liquid separation offers a continuous operation and sizable production capacity. The organophosphorus compound 2-ethylhexylphosphonic acid mono-(2-ethylhexyl) ester, also known under the common names EHEHPA or PC88A, is a well known extractant used industrially to separate the light REEs (lanthanum-gadolinium) from heavy REEs (yttrium, terbium-lutetium) as well as to purify individual elements. However, the adjacent lanthanide selectivity is quite low, with a reported selectivity for Nd over Pr in the REE(III)-HCl-EHEHPA system being just 1.17 (Xie, F. et al., *Minerals Engineering,* 2014, 56, 10-28). Another drawback of the EHEHPA process is the chemical nature and pH-swing mechanism by which the organophosphorus acids operate, which requires the consumption of acid and base via saponification to overcome the adverse liberation of acid encountered during REE extraction.

To increase the domestic supply of REEs, new and more effective methods for extracting and separating REEs from industrial byproduct streams are needed. There would also be an advantage in an extraction method that can remove one or more REEs more selectively than one or more other REEs, so as to permit a separation of REEs, particularly REEs that are adjacent to each other in the Periodic Table. There would be a further advantage in such a method using straight-forward and low-cost means for extraction and separation of REEs.

SUMMARY OF THE INVENTION

The present disclosure is foremost directed to a straight-forward and low cost method for separating adjacent lanthanide elements, which are lanthanide elements differing by one atomic number. The method relies on novel hydrophilic phenanthroline derivatives for selectively complexing with lighter lanthanide ions elements from acidic aqueous solutions containing a mixture that includes adjacent lanthanide elements. By selectively binding to lighter lanthanide elements, the hydrophilic phenanthroline derivatives function to retain (hold back) the complexed lighter element(s) in an aqueous phase when the aqueous phase is in contact with a hydrophobic (non-aqueous) extracting phase. The method simultaneously includes a lipophilic extractant compound in the hydrophobic extracting phase, wherein the lipophilic extractant compound is selective for heavier lanthanide elements. The dual action of the hydrophilic hold-back agent in the hydrophilic phase and the lipophilic extractant compound in the hydrophobic phase results in an exceptional selectivity (e.g., 2, 3, 4, or higher) for separation of adjacent lanthanide elements.

More particularly, the method includes: (i) providing an acidified aqueous solution containing adjacent lanthanide elements complexed with an aqueous lanthanide complexing agent having a phenanthroline-based structure, wherein the aqueous lanthanide complexing agent according to Formula (1) complexes more strongly with lighter lanthanide ions compared to heavier lanthanide ions and thereby more strongly retains lighter lanthanide ions in the acidified aqueous solution compared to heavier lanthanide ions; and (ii) contacting the acidified aqueous solution with an aqueous-insoluble hydrophobic solution comprising a lipophilic lanthanide extractant compound dissolved in an aqueous-insoluble hydrophobic solvent, wherein the lipophilic lanthanide extractant compound complexes more strongly with heavier lanthanide ions compared to lighter lanthanide ions, to result in the lipophilic lanthanide extractant compound more selectively extracting one or more heavier lanthanide ions from the acidified aqueous solution into the hydrophobic solution.

The present disclosure is also directed to the novel hydrophilic phenanthroline derivatives (compounds) useful as hold-back agents in the method. The hydrophilic phenanthroline derivatives have the following structure:

(1)

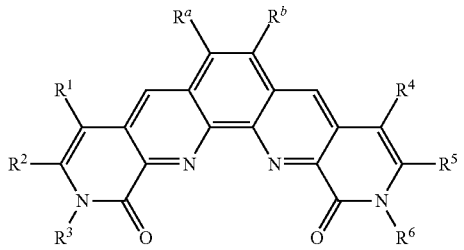

In Formula (1), $R^1$, $R^2$, $R^4$, and $R^5$ are independently selected from hydrogen atom (H), alkyl groups containing 1-3 carbon atoms, and hydrophilic groups containing at least one oxygen atom; $R^3$ and $R^6$ are independently selected from hydrogen atom, alkyl groups containing 1-3 carbon atoms, and hydrophilic groups containing at least one oxygen atom; and $R^a$ and $R^b$ are independently selected from hydrogen atom, methyl group, halogen atoms, and hydrophilic groups containing at least one oxygen atom; wherein at least two of $R^1$, $R^2$, $R^3$, $R^4$, $R^5$, $R^6$, $R^a$, and $R^b$ are said hydrophilic groups. In some embodiments, $R^3$ and $R^6$ are H. In further or separate embodiments, $R^a$ and $R^b$ are H. Moreover, in some embodiments, $R^1$ and $R^2$ may interconnect to form a ring and/or $R^4$ and $R^5$ may interconnect to form a ring (e.g., a phenyl ring), and wherein the ring may be substituted (e.g., with an alkyl group, halogen atom, and/or hydrophilic group) or unsubstituted.

In some embodiments of Formula (1), $R^a$ and $R^b$ are H, and $R^1$, $R^2$, $R^3$, $R^4$, $R^5$, and $R^6$ are independently selected from hydrogen atom and hydrophilic groups containing at least one oxygen atom, wherein at least two of $R^1$, $R^2$, $R^3$, $R^4$, and $R^6$ are said hydrophilic groups. In some embodiments, at least four of $R^1$, $R^2$, $R^3$, $R^4$, $R^5$, and $R^6$ are said hydrophilic groups. In some embodiments, the hydrophilic groups are selected from hydroxy-containing groups, ether-containing groups, groups containing both hydroxy and ether groups, carboxylic acid groups, sulfonic acid groups, and nitro groups. In some embodiments, at least two of $R^1$, $R^2$, $R^3$, $R^4$, $R^5$, and $R^6$ have the formula —$(CH_2CH_2O)_n$—$CH_2CH_2OH$, wherein n is 0-6, 1-6, or 2-6. In some embodiments, at least four of $R^1$, $R^2$, $R^3$, $R^4$, $R^5$, and $R^6$ have the formula —$(CH_2CH_2O)_n$—$CH_2CH_2OH$, wherein n is 0-6, 1-6, or 2-6.

In more specific embodiments, the hydrophilic phenanthroline derivatives have the following structure:

(1a)

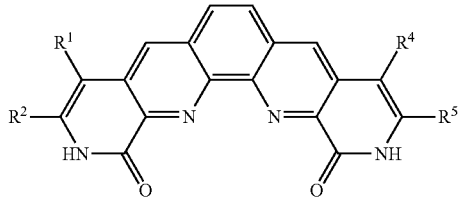

In Formula (1a), $R^1$, $R^2$, $R^4$, and $R^5$ are as defined above, or more specifically, $R^1$, $R^2$, $R^4$, and $R^5$ may be independently selected from hydrogen atom and hydrophilic groups containing at least one oxygen atom, wherein at least two of $R^1$, $R^2$, $R^4$, and $R^5$ are said hydrophilic groups. In some embodiments, at least two of $R^1$, $R^2$, $R^4$, and $R^5$ have the formula —$(CH_2CH_2O)_n$—$CH_2CH_2OH$, wherein n is 0-6, 1-6, or 2-6. In some embodiments, each of $R^1$, $R^2$, $R^3$, $R^4$, $R^5$, and $R^6$ independently has the formula —$(CH_2CH_2O)$, —$CH_2CH_2OH$, wherein n is 0-6, 1-6, or 2-6.

BRIEF DESCRIPTION OF THE DRAWINGS

FIG. 3*a* is a graph showing variation in $[Pr]_{aq}$ after extraction with 0.1 M of Ligand 3 in n-dodecane with 10 vol % 1-octanol from 1 M $HNO_3$ containing 13 mM of Ligand 1 and varying concentrations of Pr ($[Pr]_0$). FIG. 3*b* is a graph showing variation in log $D_{Pr}$ and log $D_{Nd}$ with aqueous phase acidity after extraction with 0.1 M of Ligand 3 in n-dodecane with 10 vol % 1-octanol from $aqHNO_3$ containing 13 mM of Ligand 1. FIG. 3*c* is a graph showing variation in log $D_{Pr}$ and log $D_{Nd}$ after extraction with 15-200 mM of Ligand 3 in n-dodecane with 10 vol % 1-octanol from 1 M $HNO_3$ containing 13 mM of Ligand 1.

FIG. 5*a* is a graph showing Guinier analysis derived from SAXS measurements at low q with linear regression to describe the radius of gyration ($R_g$). FIG. 5*b* is a graph showing Fourier-transformed EXAFS measurements of various aqueous Pr solutions with 13 mM of Ligand 1 (solid line and dashed line traces) and without Ligand 1 (dotted trace). The inset illustrates the slight shift in average 1st shell bond distance when Pr is complexed with Ligand 1.

DETAILED DESCRIPTION OF THE INVENTION

Figures 1A, 1B, 1C, 1D, 1E, 1F, 1G, 1H, 1I:
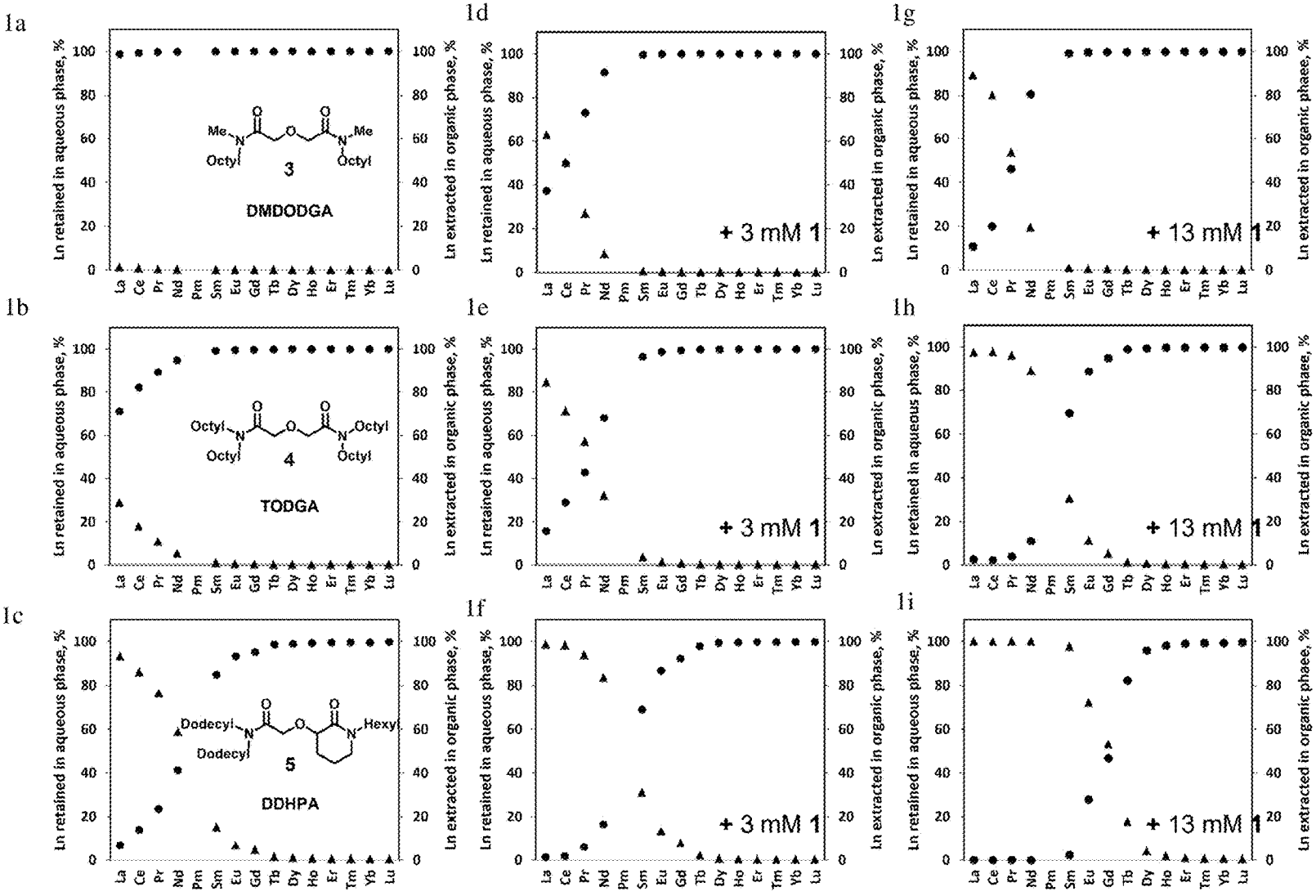
FIGS. 1*a*-1*i* show chemical structures of DGA Ligands 3, 4, and 5. The graphs show the calculated variation in the extraction of 14 lanthanides (excluding Pm), 0.5 mM each, with 0.1 M of Ligands 3, 4, and 5 from 1 M $HNO_3$ (pH 0) into n-dodecane with 10 vol % 1-octanol at 25.5±0.5° C. after 1 h in the absence (FIGS. 1*a*-1*c*) and presence of Ligand 1 at 3 mM concentration (FIGS. 1*d*-1*f*) and 13 mM concentration (FIGS. 1*g*-1*i*).

As used herein, the term "hydrocarbon group" (also denoted by the group R) is defined as a chemical group composed solely of carbon and hydrogen, except that the hydrocarbon group may (i.e., optionally) be substituted with one or more fluorine atoms to result in partial or complete fluorination of the hydrocarbon group, and/or the hydrocarbon group may or may not also contain a single ether or thioether linkage connecting between carbon atoms in the hydrocarbon group. The hydrocarbon group typically contains 1-30 carbon atoms. In different embodiments, one or more of the hydrocarbon groups may contain, for example, 1, 2, 3, 4, 5, 6, 7, 8, 9, 10, 12, 15, 18, 20, 22, 24, 26, 28, or 30 carbon atoms, or a number of carbon atoms within a particular range bounded by any two of the foregoing carbon numbers (e.g., 1-30, 2-30, 3-30, 4-30, 6-30, 8-30, 10-30, 12-30, 1-20, 6-20, 8-20, 10-20, or 12-20 carbon atoms). Hydrocarbon groups in different compounds described herein, or in different positions of a compound, may possess the same or different number (or preferred range thereof) of carbon atoms in order to independently adjust or optimize such properties as the complexing ability, extracting (extraction affinity) ability, selectivity ability, or third phase prevention ability of the compound.

In a first set of embodiments, the hydrocarbon group (R) is a saturated and straight-chained group, i.e., a straight-chained (linear) alkyl group. Some examples of straight-chained alkyl groups include methyl, ethyl, n-propyl, n-butyl, n-pentyl, n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl, n-octadecyl, n-eicosyl, n-docosyl, n-tetracosyl, n-hexacosyl, n-octacosyl, and n-triacontyl groups.

In a second set of embodiments, the hydrocarbon group (R) is saturated and branched, i.e., a branched alkyl group. Some examples of branched alkyl groups include isopropyl (2-propyl), isobutyl (2-methylprop-1-yl), sec-butyl (2-butyl), t-butyl (1,1-dimethylethyl-1-yl), 2-pentyl, 3-pentyl, 2-methylbut-1-yl, isopentyl (3-methylbut-1-yl), 1,2-dimethylprop-1-yl, 1,1-dimethylprop-1-yl, neopentyl (2,2-dimethylprop-1-yl), 2-hexyl, 3-hexyl, 2-methylpent-1-yl, 3-methylpent-1-yl, isohexyl (4-methylpent-1-yl), 1,1-dimethylbut-1-yl, 1,2-dimethylbut-1-yl, 2,2-dimethylbut-1-yl, 2,3-dimethylbut-1-yl, 3,3-dimethylbut-1-yl, 1,1,2-trimethylprop-1-yl, 1,2,2-trimethylprop-1-yl, isoheptyl, isooctyl, and the numerous other branched alkyl groups having up to 20 or 30 carbon atoms, wherein the "1-yl" suffix represents the point of attachment of the group.

In a third set of embodiments, the hydrocarbon group (R) is saturated and cyclic, i.e., a cycloalkyl group. Some examples of cycloalkyl groups include cyclopropyl, cyclobutyl, cyclopentyl, cyclohexyl, cycloheptyl, and cyclooctyl groups. The cycloalkyl group can also be a polycyclic (e.g., bicyclic) group by either possessing a bond between two ring groups (e.g., dicyclohexyl) or a shared (i.e., fused) side (e.g., decalin and norbornane).

In a fourth set of embodiments, the hydrocarbon group (R) is unsaturated and straight-chained, i.e., a straight-chained (linear) olefinic or alkenyl group. The unsaturation occurs by the presence of one or more carbon-carbon double bonds and/or one or more carbon-carbon triple bonds. Some examples of straight-chained olefinic groups include vinyl, propen-1-yl (allyl), 3-buten-1-yl ($CH_2{=}CH{-}CH_2{-}CH_2{-}$), 2-buten-1-yl ($CH_2{-}CH{=}CH{-}CH_2{-}$), butadienyl, 4-penten-1-yl, 3-penten-1-yl, 2-penten-1-yl, 2,4-pentadien-1-yl, 5-hexen-1-yl, 4-hexen-1-yl, 3-hexen-1-yl, 3,5-hexadien-1-yl, 1,3,5-hexatrien-1-yl, 6-hepten-1-yl, ethynyl, propargyl (2-propynyl), 3-butynyl, and the numerous other straight-chained alkenyl or alkynyl groups having up to 20 or 30 carbon atoms.

In a fifth set of embodiments, the hydrocarbon group (R) is unsaturated and branched, i.e., a branched olefinic or alkenyl group. Some examples of branched olefinic groups include propen-2-yl ($CH_2{=}C{\cdot}{-}CH_3$), 1-buten-2-yl ($CH_2{=}C{\cdot}{-}CH_2{-}CH_3$), 1-buten-3-yl ($CH_2{=}CH{-}CH{\cdot}{-}CH_3$), 1-propen-2-methyl-3-yl ($CH_2{=}C(CH_3){-}CH_2{-}$), 1-penten-4-yl, 1-penten-3-yl, 1-penten-2-yl, 2-penten-2-yl, 2-penten-3-yl, 2-penten-4-yl, and 1,4-pentadien-3-yl, and the numerous other branched alkenyl groups having up to 20 or 30 carbon atoms, wherein the dot in any of the foregoing groups indicates a point of attachment.

In a sixth set of embodiments, the hydrocarbon group (R) is unsaturated and cyclic, i.e., a cycloalkenyl group. The unsaturated cyclic group may be aromatic or aliphatic. Some examples of unsaturated cyclic hydrocarbon groups include cyclopropenyl, cyclobutenyl, cyclopentenyl, cyclopentadienyl, cyclohexenyl, cyclohexadienyl, phenyl, benzyl, cycloheptenyl, cycloheptadienyl, cyclooctenyl, cyclooctadienyl, and cyclooctatetraenyl groups. The unsaturated cyclic hydrocarbon group may or may not also be a polycyclic group (such as a bicyclic or tricyclic polyaromatic group) by either possessing a bond between two of the ring groups (e.g., biphenyl) or a shared (i.e., fused) side, as in naphthalene, anthracene, phenanthrene, phenalene, or indene fused ring systems.

As indicated earlier above, any of the hydrocarbon groups described above may be substituted with one or more fluorine atoms. As an example, an n-octyl group may be substituted with a single fluorine atom to result in, for example, a 7-fluorooctyl or 8-fluorooctyl group, or substituted with two or more fluorine atoms to result in, for example, 7,8-difluorooctyl, 8,8-difluorooctyl, 8,8,8-trifluorooctyl, or perfluorooctyl group. As also indicated earlier above, any of the hydrocarbon groups described above may contain a single ether (—O—) or thioether (—S—) linkage connecting between carbon atoms in the hydrocarbon group. An example of a hydrocarbon group containing a single ether or thioether group is $-(CH_2)_2-X-(CH_2)_7CH_3$, wherein X represents 0 or S. Moreover, an aromatic or aliphatic ring may contain one or more ring nitrogen atoms, such as in pyridine.

In one aspect, the present disclosure is directed to hydrophilic phenanthroline compounds (i.e., hydrophilic lanthanide complexing agents) having an ability to complex more strongly (more selectively) with lighter lanthanide elements in an aqueous acidic solution containing a mixture of lanthanide elements. The hydrophilic phenanthroline compounds are within the scope of the following generic structure:

(1)

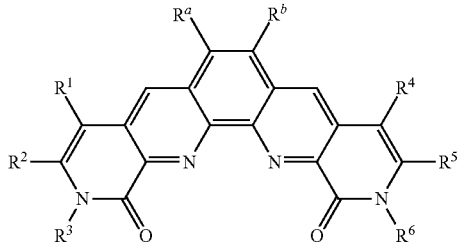

In Formula (1), the variables $R^1$, $R^2$, $R^4$, and $R^5$ are independently selected from hydrogen atom (H), alkyl groups containing 1-3 carbon atoms (e.g., methyl, ethyl, n-propyl, or isopropyl), and hydrophilic groups containing at least one oxygen atom. The variables $R^3$ and $R^6$ are independently selected from hydrogen atom, alkyl groups containing 1-3 carbon atoms, and hydrophilic groups containing at least one oxygen atom. The variables $R^a$ and $R^b$ are independently selected from hydrogen atom, methyl group, halogen atoms, and hydrophilic groups containing at least one oxygen atom. Halogen atoms include fluorine (F), chlorine (Cl), bromine (Br), and iodine (I). To ensure a hydrophilic property of the compounds of Formula (1), at least two, three, four, five, or six of $R^1$, $R^2$, $R^3$, $R^4$, $R^5$, $R^6$, $R^a$ and $R^b$ are selected from hydrophilic groups. In some embodiments, precisely or at least two, three, or four of $R^1$, $R^2$, $R^3$, $R^4$, $R^5$, $R^6$, or precisely or at least two, three, or four (all) of $R^1$, $R^2$, $R^4$, and $R^5$ are hydrophilic groups. In some embodiments, one or both of $R^3$ and $R^6$ are H atoms. In some embodiments, one or both of $R^a$ and $R^b$ are H atoms. Moreover, in some embodiments, $R^1$ and $R^2$ may interconnect to form a ring and/or $R^4$ and $R^5$ may interconnect to form a ring, wherein the ring may any of the aromatic or aliphatic rings described above, such as a phenyl ring, wherein the ring may be substituted (e.g., with an alkyl group, halogen atom, and/or hydrophilic group) or unsubstituted and may or may not contain one or more ring nitrogen atoms.

In some embodiments of Formula (1), $R^1$, $R^2$, $R^3$, $R^4$, $R^5$, and $R^6$ are independently selected from hydrogen atom and hydrophilic groups containing at least one oxygen atom, wherein at least two, three, four, five, or six (all) of $R^1$, $R^2$, $R^3$, $R^4$, $R^5$, and $R^6$ are hydrophilic groups. In some embodiments, precisely or at least two, three, or four (all) of $R^1$, $R^2$, and $R^5$ are hydrophilic groups. In some embodiments, one or both of $R^3$ and $R^6$ are H atoms.

The hydrophilic groups may be selected from any of the hydrophilic groups known in the art. The hydrophilic groups may be ionic or non-ionic hydrophilic groups. Some examples of hydrophilic groups include hydroxy-containing groups, ether-containing groups, groups containing both hydroxy and ether groups, carboxylic acid (COOH), sulfonic acid ($SO_3H$), and nitro ($NO_2$) groups. Some examples of hydroxy-containing groups include —$CH_2CH_2OH$, —CH(OH)$CH_2$(OH), —CH(OH)$CH_2$(OH), and —CH[$CH_2$(OH)]2 groups. Some examples of ether-containing groups include —$CH_2OCH_3$, —$CH_2CH_2OCH_3$, —$CH_2OCH_2CH_3$, —$CH_2CH_2OCH_2CH_3$, —$CH_2OCH_2CH_2OCH_3$, —$CH_2OCH_2CH_2OCH_2CH_3$, —CH[$CH_2(OCH_3)$]2, —CH[$CH_2(OCH_2CH_2OCH_3)$]2, and —$CH_2O(CH_2CH_2O)_mCH_3$, where m is at least 1, 2, 3, 4, 5, or 6. Some examples of hydrophilic groups containing both ether and hydroxy groups include —$(CH_2CH_2O)_n$—$CH_2CH_2OH$, wherein n is 0, 1, 2, 3, 4, 5, and 6 or within a range therein (e.g., 0-6, 1-6, or 2-6). Any of $R^1$, $R^2$, $R^3$, $R^4$, $R^5$, $R^6$, $R^a$ and $R^b$ may be independently selected from any of the hydrophilic groups described above. In some embodiments, precisely or at least two, three, or four of $R^1$, $R^2$, $R^3$, $R^4$, $R^5$, $R^6$, $R^a$ and $R^b$ or precisely or at least two, three, or four of $R^1$, $R^2$, $R^3$, $R^4$, $R^5$, and $R^6$ (or two, three, or all of $R^1$, $R^2$, $R^4$, and $R^5$) have the formula —$(CH_2CH_2O)_n$—$CH_2CH_2OH$, wherein n is 0-6, 1-6, 2-6, or 3-6.

In some embodiments, the hydrophilic phenanthroline compounds have the formula:

(1a)

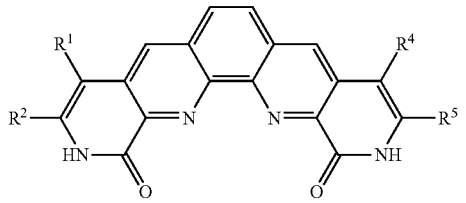

In Formula (1a), $R^1$, $R^2$, $R^4$, and $R^5$ are as defined above under Formula (1), or $R^1$, $R^2$, $R^4$, and $R^5$ may be more particularly selected (independently) from hydrogen atom and hydrophilic groups containing at least one oxygen atom, as described above, wherein at least two, three, or all of $R^1$, $R^2$, $R^4$, and $R^5$ are said hydrophilic groups. In some embodiments, at least two, three, or all of $R^1$, $R^2$, $R^4$, and $R^5$ are selected from hydroxy-containing groups, ether-containing groups, groups containing both hydroxy and ether groups, carboxylic acid groups, sulfonic acid groups, and/or nitro groups. In some embodiments, precisely or at least two, three, or all of $R^1$, $R^2$, $R^4$, and $R^5$ have the formula —$(CH_2CH_2O)$, —$CH_2CH_2OH$, wherein n is 0-6, 1-6, 2-6, or 3-6. In some embodiments, each of $R^1$, $R^2$, $R^4$, and $R^5$ independently has the formula —$(CH_2CH_2O)_n$—$CH_2CH_2OH$, wherein n is 0-6, 1-6, 2-6, or 3-6.

As noted earlier above, in some embodiments of Formula (1) or (1a), $R^1$ and $R^2$ may interconnect to form a ring and/or $R^4$ and $R^5$ may interconnect to form a ring. Some molecules in which $R^1$ and $R^2$ interconnect to form a ring and $R^4$ and $R^5$ may interconnect to form a ring are represented by the following formula:

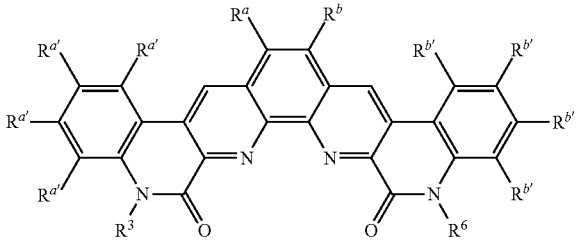

wherein $R^a$, $R^b$, $R^3$, and $R^6$ are as defined earlier above, and $R^{a'}$ and $R^{b'}$ are independently selected, in each instance, from H, methyl group, halogen atoms, and hydrophilic groups containing at least one oxygen atom.

Compounds of Formula (1) and (1a) can be synthesized by means well known in the art. For example, $N^2$,$N^9$-bis(pivaloyloxy)-1,10-phenanthroline-2,9-dicarboxamide (SI-1) may be reacted with an alkyne molecule containing one or two hydrophilic groups (e.g., hydroxy, ether, or hydroxy-alkylether) in the presence of a Rh catalyst, such as $[Cp^*RhCl_2]_2$, and Cs carboxylate to produce a compound of Formula (1) or (1a).

In another aspect, the present disclosure is directed to a hydrophobic extractant solution useful for more preferentially extracting heavier lanthanide elements from aqueous solutions containing a mixture of lanthanide elements. The hydrophobic extractant solution is aqueous-insoluble, and thus, insoluble with the acidic aqueous solution containing the aqueous lanthanide complexing agent and mixture of lanthanide elements.

The hydrophobic extractant solution includes one or more lipophilic lanthanide extractant compounds (i.e., lipophilic extractant compounds) dissolved in an aqueous-insoluble hydrophobic solvent. The lipophilic extractant compound complexes more strongly with heavier lanthanide ions compared to lighter lanthanide ions, which results in the lipophilic extractant compound more selectively extracting one or more heavier lanthanide ions from the acidified aqueous solution into the hydrophobic extractant solution.

In the hydrophobic extractant solution, the aqueous-insoluble hydrophobic solvent can be any of the hydrophobic organic solvents known in the art that are substantially or completely immiscible with water or aqueous solutions in general. The aqueous-insoluble hydrophobic solvent is typically a hydrocarbon solvent, which may be non-halogenated (e.g., hexanes, heptanes, octanes, decanes, dodecanes, benzene, toluene, xylenes, kerosene, or petroleum ether), or halogenated (e.g., methylene chloride, chloroform, carbon tetrachloride, 1,2-dichlorethane, trichloroethylene, and perchloroethylene), or etherified (e.g., diethyl ether or diisopropyl ether), or combination of halogenated and etherified (e.g., bis(chloroethyl)ether and 2-chloroethyl vinyl ether). In some embodiments, the hydrophobic extractant solution is composed solely of the lipophilic extractant compound and the aqueous-insoluble hydrophobic solvent. In other embodiments, the hydrophobic extractant solution contains one or more additional components, as further discussed below. The one or more lipophilic extractant compounds may be present in the hydrophobic extractant solution in a concentration of, for example, precisely, at least, or up to, for example, 0.01 M, 0.02 M, 0.05 M, 0.1 M, 0.2 M, 0.3 M, 0.4 M, 0.5 M, 0.6 M, 0.7 M, 0.8 M, 0.9 M, or 1 M or a concentration within a range bounded by any two of the foregoing values, e.g., 0.01-1 M, 0.01-0.5 M, 0.05-1 M, 0.05-0.5 M, 0.1-1 M, 0.1-0.8 M, 0.1-0.5 M, 0.2-1 M, 0.2-0.8 M, or 0.2-0.5 M.

The lipophilic lanthanide extractant compound has the following structure:

X-L-Y (2)

In the above Formula (2), X and Y are independently selected from —C(O)NR$_2$ and —P(O)R$_2$, wherein R is independently selected, in each instance, from hydrocarbon groups containing 1-30 carbon atoms and optionally containing an ether or thioether linkage connecting between carbon atoms, as described above, provided that the total carbon atoms in X and Y combined is at least 12. The variable L is a linker containing at least one carbon atom and typically up to 2, 3, 4, 5, or 6 carbon atoms and optionally containing an ether (—O—) linkage. In some embodiments, L is an alkylene linker of the formula —(CH$_2$)$_p$—, wherein p is 1, 2, 3, 4, 5, or 6 and wherein one or two of the H atoms may be substituted by one or more hydrocarbon groups containing 1-3 carbon atoms. In other embodiments, L is an alkylene oxide linker of the formula —(CH$_2$)$_r$—O—(CH$_2$)$_s$—, wherein r and s are independently 1, 2, or 3 and may be the same or different, and wherein one or two of the H atoms may be substituted by one or more hydrocarbon groups containing 1-3 carbon atoms.

In some embodiments, the lipophilic extractant compound may have any of the following general structures:

(2a)

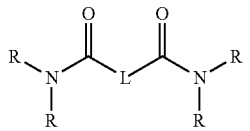

(2b)

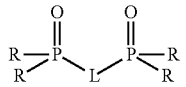

(2c)

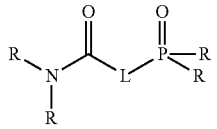

In Formulas (2a), (2b), and (2c), each instance of R and L is independently selected from groups provided earlier above.

In particular embodiments, the lipophilic extractant compound has a structure within the following generic structure:

(2a-1)

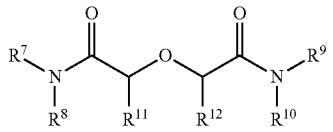

In Formula (2a-1) above, R$^7$, R$^8$, R$^9$, and R$^{10}$ are independently selected from linear, branched, or cyclic hydrocarbon groups, or more particularly, alkyl groups (R') containing 1-30 carbon atoms, as described above, provided that the total carbon atoms in R$^7$, R$^8$, R$^9$, and R$^{10}$ (i.e., the sum of carbon atoms in all of R$^7$, R$^8$, R$^9$, and R$^{10}$) is at least 12. In different embodiments, the total carbon atoms in R$^7$, R$^8$, R$^9$, and R$^{10}$ is at least 12, 13, 14, 15, 16, 18, 20, 22, 24, 26, 28, 30, 32, 34, 36, 38, 40, 42, 44, 46, 48, 50, 52, 54, 56, 60, 64, 68, 70, 72, 76, or 80, or a total carbon number within a range bounded by any two of the foregoing values (e.g., 12-80). In some embodiments, R$^7$, R$^8$, R$^9$, and R$^{10}$ are the same, such as in the case where R$^7$, R$^8$, R$^9$, and R$^{10}$ are each isododecyl, i.e., —(CH$_2$)$_9$CH(CH$_3$)$_2$, in which case the total carbon number provided by R$^7$, R$^8$, R$^9$, and R$^{10}$ is 48. The term "same," as used herein, refers at least to the same carbon number in two or more of R$^7$, R$^8$, R$^9$, and R$^{10}$, and the term may further refer to the same structure. In other embodiments, at least one of R$^7$, R$^8$, R$^9$, and R$^{10}$ is different from another of R$^7$, R$^8$, R$^9$, and R$^{10}$, such as in the case where R$^7$ and R$^9$ are methyl groups and R$^8$ and R$^{10}$ are isooctyl groups (which results in a symmetric structure), or where R$^7$ and R$^8$ are methyl groups and R$^9$ and R$^{10}$ are isooctyl groups (which results in an asymmetric structure). In either of the foregoing cases, the total carbon number provided by R$^7$, R$^8$, R$^9$, and R$^{10}$ is 18. As noted in the above examples, the structure according to Formula (2a-1) may be symmetric or asymmetric. Another example of an asymmetric structure is one in which R$^7$, R$^8$, and R$^9$, are equivalent to each other while different from R$^{10}$.

The groups R$^{11}$ and R$^{12}$ in Formula (2a-1) above are independently selected from hydrogen atom and hydrocarbon groups containing 1-3 carbon atoms. In a first set of embodiments, R$^{11}$ and R$^{12}$ are hydrogen atoms. In a second set of embodiments, R$^{11}$ and R$^{12}$ are hydrocarbon groups containing 1-3 carbon atoms. In a third set of embodiments, one of R$^{11}$ and R$^{12}$ is a hydrogen atom and the other is a hydrocarbon group containing 1-3 carbon atoms. In the case where one or both of R$^{11}$ and R$^{12}$ is a hydrocarbon, the hydrocarbon is typically an alkyl group, typically containing 1-6 carbon atoms, and more particularly, a methyl, ethyl, n-propyl, or isopropyl group. R$^8$ and R$^{11}$ optionally interconnect to form a lactam ring, and/or R$^{10}$ and R$^{12}$ optionally interconnect to form a lactam ring.

In some embodiments, R$^7$, R$^8$, R$^9$, and R$^{10}$ are all alkyl groups, which may be the same or different. A sub-class of Formula (2a-1) in which R$^7$, R$^8$, R$^9$, and R$^{10}$ are all alkyl groups can be described by the following sub-formula:

(I)

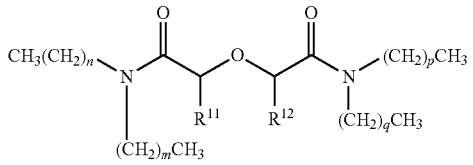

wherein m, n, p, and q are each independently an integer of 0-30, provided that the sum of m, n, p, and q is at least 8, and where R$^{11}$ and R$^{12}$ are as defined above. In some embodiments, m, n, p, and q are the same, such as m, n, p, and q all being 3, 4, 5, 6, 10, 12, 14, 16, 18, 20, 22, 24, 26, 28, or 30. In other embodiments, m, n, p, and q are not all the same, such as m and q being 0 and n and p each being 3, 4, 5, 6, 10, 12, 14, 16, 18, 20, 22, 24, 26, 28, or 30; or, as another example, m and q being 1 or 2 and n and p each being 3, 4, 5, 6, 10, 12, 14, 16, 18, 20, 22, 24, 26, 28, or 30. Moreover, any one or more hydrogen atoms in methylene groups in Formula (I) may optionally be replaced with a methyl, ethyl, n-propyl, or isopropyl group, to result in a branched hydrocarbon group, provided that the branched hydrocarbon group contains up to 30 carbon atoms, as provided in Formula (1).

Some examples of specific compounds under Formula (I) in which all alkyl groups corresponding to $R^7$, $R^8$, $R^9$, and $R^{10}$ are the same are provided as follows:

(I-1)

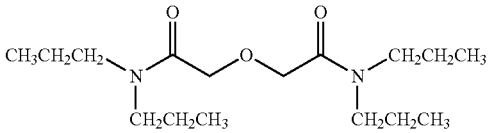

(I-2)

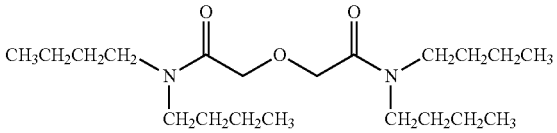

(I-3)

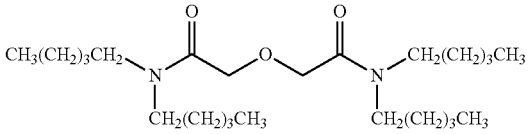

(I-4)

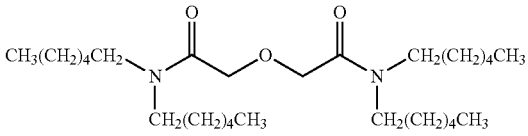

(I-5)

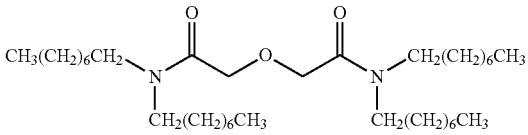

(I-6)

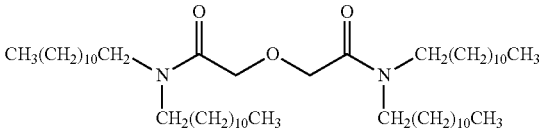

(I-7)

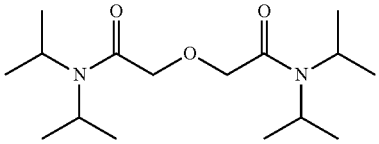

(I-8)

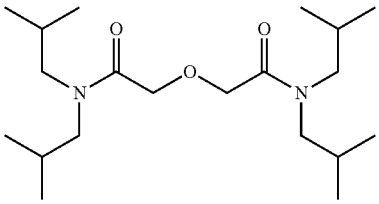

-continued (I-9)

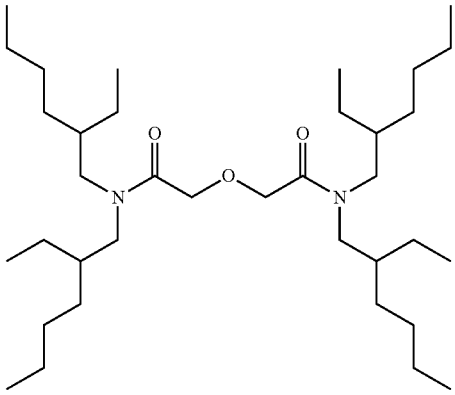

Some examples of specific compounds under Formula (2a-1) in which not all alkyl groups corresponding to $R^7$, $R^8$, $R^9$, and $R^{10}$ are the same are provided as follows:

(I-10)

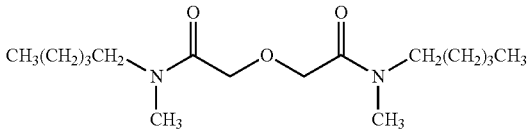

(I-11)

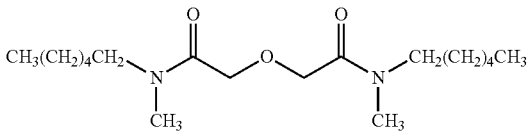

(I-12)

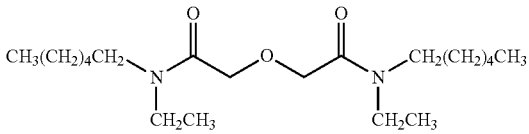

(1a-13)

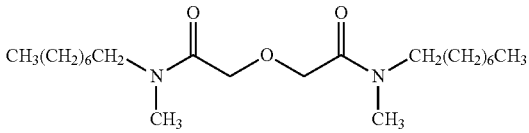

(I-14)

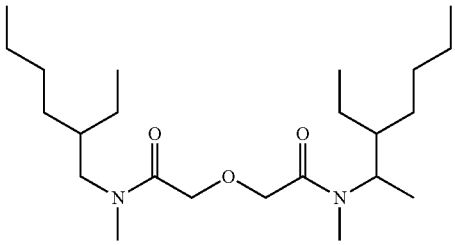

In some embodiments of Formula (2a-1), a first condition applies in which at least one (e.g., one, two, three, or all) of $R^7$, $R^8$, $R^9$, and $R^{10}$ is a distal branched alkyl group constructed of a linear alkyl backbone having at least four, five, six, seven, eight, nine, ten, eleven, or twelve carbon atoms with an alpha carbon atom of the linear alkyl backbone attached to a nitrogen atom shown in Formula (2a-1), and the linear alkyl backbone contains a substituting hydrocarbon group (which may be an alkyl group) at a gamma carbon or higher positioned carbon on the linear alkyl backbone. The substituting hydrocarbon group can be any of the hydrocarbon groups described above containing at least one or two carbon atoms, provided that the total number of carbon atoms in the distal branched alkyl group is up to 30 carbon atoms. In particular embodiments, one or more of the substituting hydrocarbon groups contain 1-6 carbon atoms, such as those selected from methyl, ethyl, n-propyl, isopropyl, n-butyl, isobutyl, sec-butyl, t-butyl, cyclopentyl, cyclohexyl, and phenyl groups. The linear alkyl backbone may be depicted as follows, with alpha, beta, gamma, delta, and epsilon positions denoted:

$$—(CH_2)_\alpha(CH_2)_\beta(CH_2)_\gamma(CH_2)_\delta(CH_2)\varepsilon(CH_2)_n(CH_3),$$

wherein n is 0 or a number of 1 or greater. In some embodiments, the distal branched alkyl group contains precisely or at least one substituting hydrocarbon group located at a gamma carbon, delta carbon, epsilon carbon, or higher carbon position (e.g., zeta, eta, theta, iota, or kappa) of the linear alkyl backbone. In other embodiments, the distal branched alkyl group contains at least two (or more) substituting hydrocarbon groups independently located at a gamma carbon, delta carbon, epsilon carbon, or higher carbon position (e.g., zeta, eta, theta, iota, or kappa) or combination of such positions of the linear alkyl backbone.

Some examples of distal branched alkyl groups according to condition 1 include:

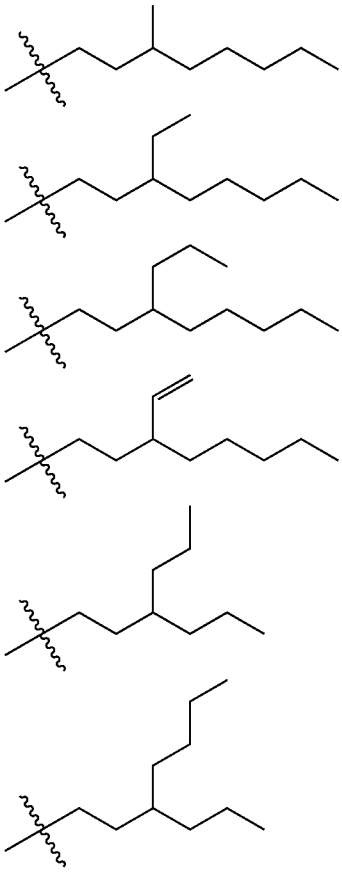

-continued

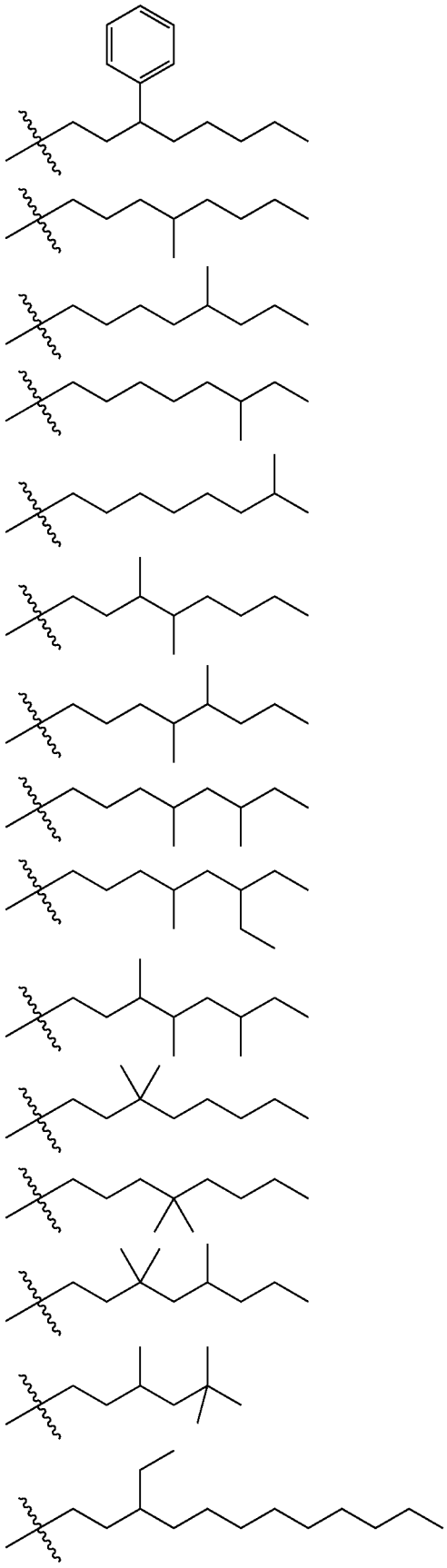

-continued

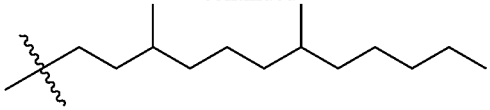

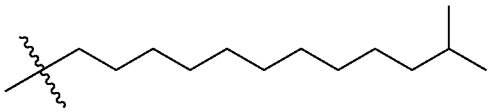

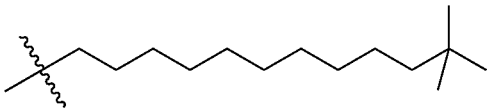

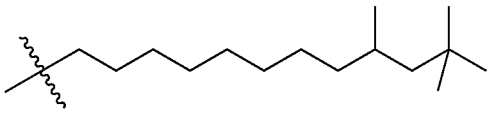

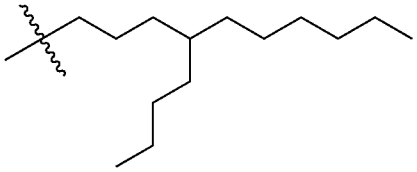

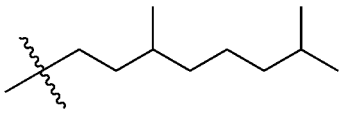

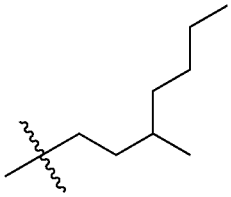

and

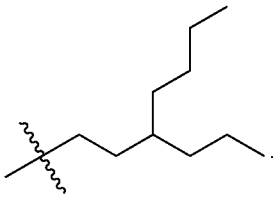

In other embodiments of Formula (2a-1), a second condition applies in which $R^7$ and $R^8$ are equivalent and $R^9$ and $R^{10}$ are separately equivalent, while $R^7$ and $R^8$ are different from $R^9$ and $R^{10}$, to result in an asymmetrical compound of Formula (1). In some embodiments, $R^7$ and $R^8$ are equivalent hydrocarbon groups (or more particularly, alkyl groups) containing 1-3 carbon atoms, and $R^9$ and $R^{10}$ are separately equivalent hydrocarbon groups containing 4-30, 6-30, 8-30, 10-30, 12-30, 4-20, 6-20, 8-20, 10-20, or 12-20 carbon atoms, wherein all such hydrocarbon groups have been described above. For example, $R^7$ and $R^8$ may both be methyl or ethyl and $R^9$ and $R^{10}$ may both be the same $C_3$-$C_{30}$, $C_4$-$C_{30}$, $C_5$-$C_{30}$, $C_6$-$C_{30}$, $C_7$-$C_{30}$, or $C_8$-$C_{30}$, linear, branched, or cyclic alkyl group, as described above, such as n-propyl, isopropyl, cyclopropyl, n-butyl, sec-butyl, isobutyl, t-butyl, cyclobutyl, n-pentyl, isopentyl, n-hexyl, isohexyl, cyclohexyl, n-octyl, isooctyl, n-decyl, n-undecyl, n-dodecyl, n-tetradecyl, n-hexadecyl, or larger group with or without substitution with one or more hydrocarbon groups (R) as described above. Alternatively, only one of $R^7$, $R^8$, $R^9$, and $R^{10}$ is different to result in an asymmetrical compound. For example, $R^7$ may be methyl or ethyl and $R^8$, $R^9$, and $R^{10}$ may all be the same $C_3$-$C_{30}$, $C_4$-$C_{30}$, $C_5$-$C_{30}$, $C_6$-$C_{30}$, $C_7$-$C_{30}$, or $C_8$-$C_{30}$, linear, branched, or cyclic alkyl group, as described above, such as n-propyl, isopropyl, cyclopropyl, n-butyl, sec-butyl, isobutyl, t-butyl, cyclobutyl, n-pentyl, isopentyl, n-hexyl, isohexyl, cyclohexyl, n-octyl, isooctyl, n-decyl, n-undecyl, n-dodecyl, n-tetradecyl, n-hexadecyl, or larger group with or without substitution with one or more hydrocarbon groups (R) as described above. Any of the alkyl groups described above may or may not contain fluorine substitution and/or an ether or thioether linkage connecting between carbon atoms.

In other embodiments of Formula (2a-1), a third condition applies in which $R^7$ and $R^8$ interconnect to form a first amine-containing ring, and/or $R^9$ and $R^{10}$ interconnect to form a second amine-containing ring. The first and second amine-containing rings are typically attached to at least one alkyl group containing at least three, four, five, six, seven, or eight carbon atoms (and up to 12, 18, 20, 24, or 30 carbon atoms), wherein the alkyl group optionally contains fluorine substitution and optionally contains an ether or thioether linkage connecting between carbon atoms. The total number of carbon atoms in the first or second amine-containing ring and attached alkyl group (combined) is typically up to 30 carbon atoms. The amine-containing ring is typically a five-membered or six-membered ring. The amine-containing ring may be substituted with an additional hydrocarbon group (R), such as any of those described above, particularly alkyl groups containing 1-4 carbon atoms, such as a methyl, ethyl, n-propyl, isopropyl group. n-butyl, sec-butyl, isobutyl, or t-butyl group.

In other embodiments of Formula (2a-1), a fourth condition applies in which $R^8$ and $R^{11}$ interconnect to form a first lactam ring, and/or $R^{10}$ and $R^{12}$ interconnect to form a second lactam ring. The lactam ring is typically a five-membered or six-membered ring. The lactam ring may also be substituted with any of the hydrocarbon groups (R) described above containing 1-30 carbon atoms, including methyl, ethyl, n-propyl, and isopropyl groups.

Some examples of lipophilic extractant compounds of Formula (2a-1) include:

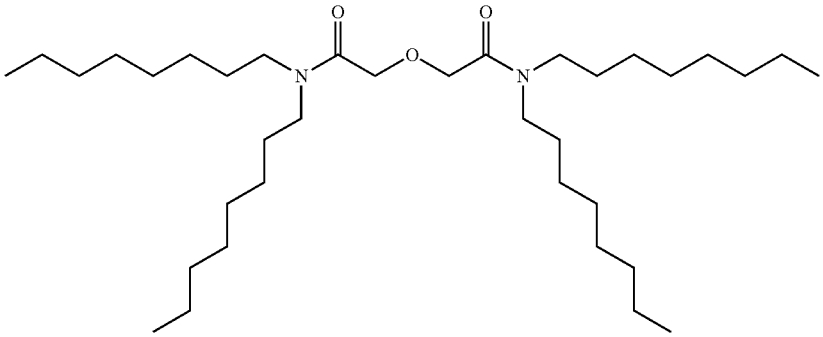
(TODGA)
3
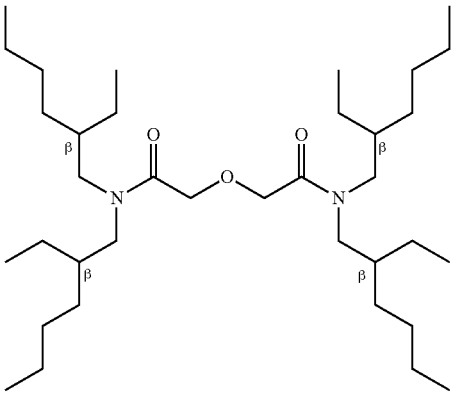
(TEHDGA)
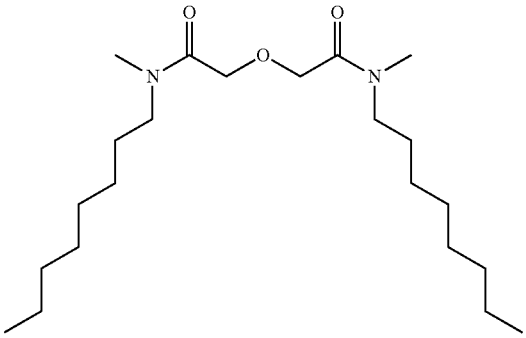
(DMDODGA)
4
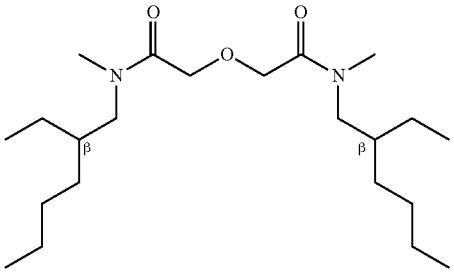
5
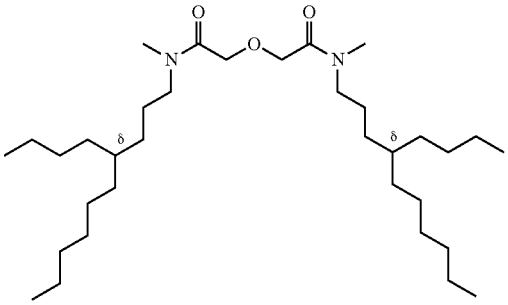
6
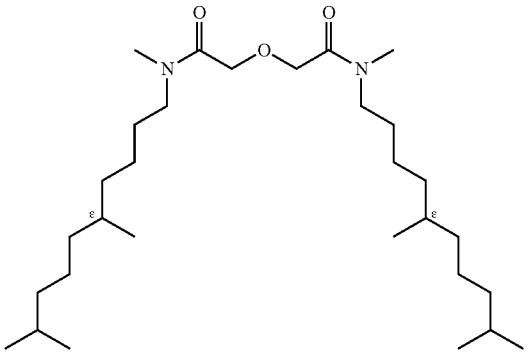
7
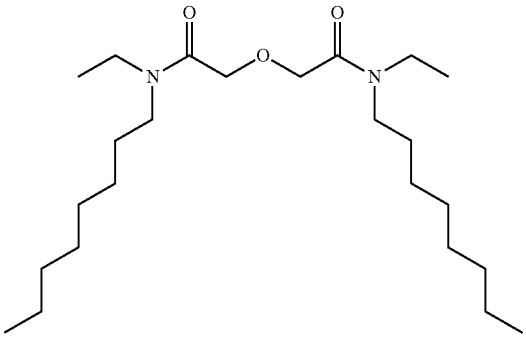

-continued
8
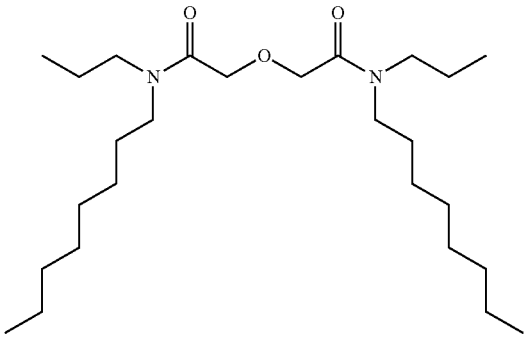
9
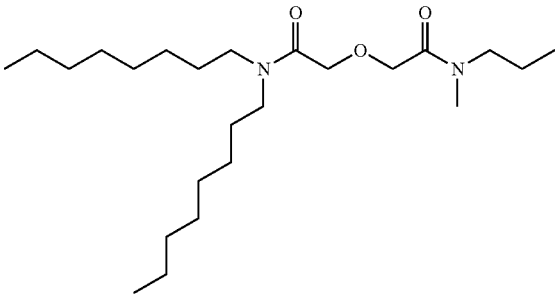
10
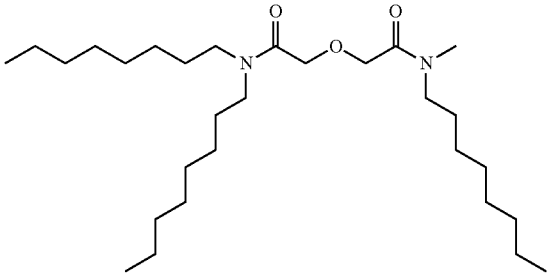
11
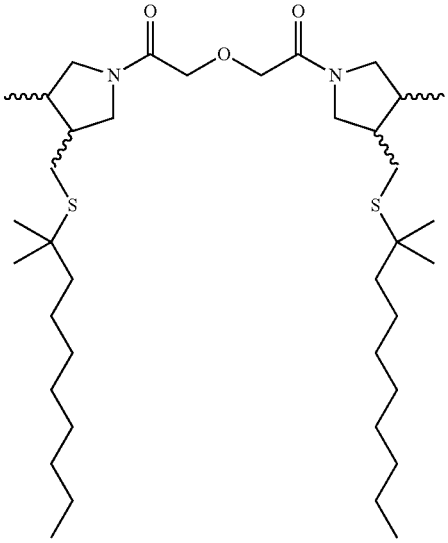
12
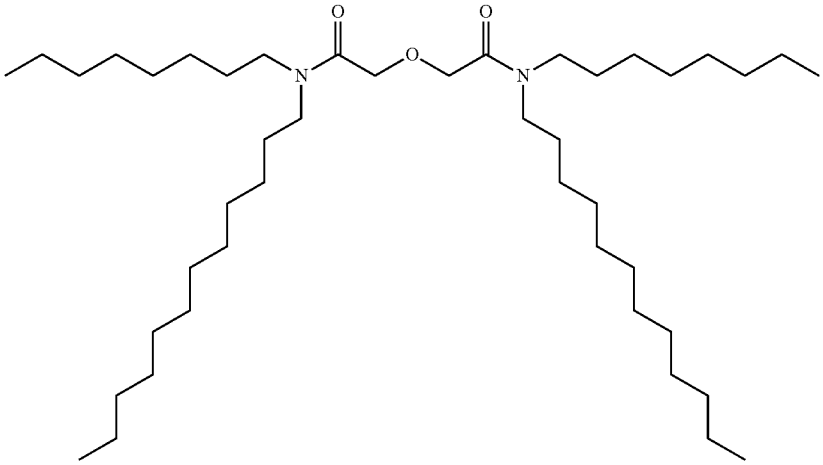

-continued
13
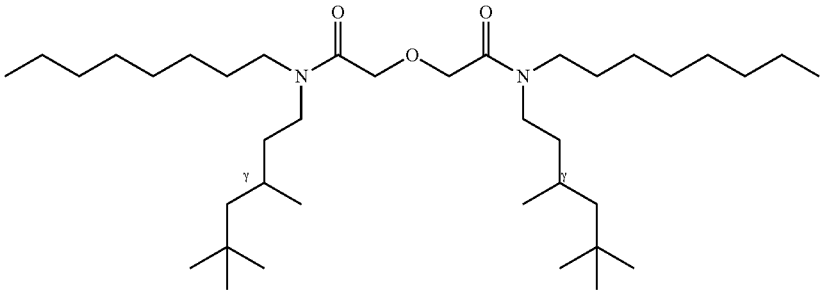
14
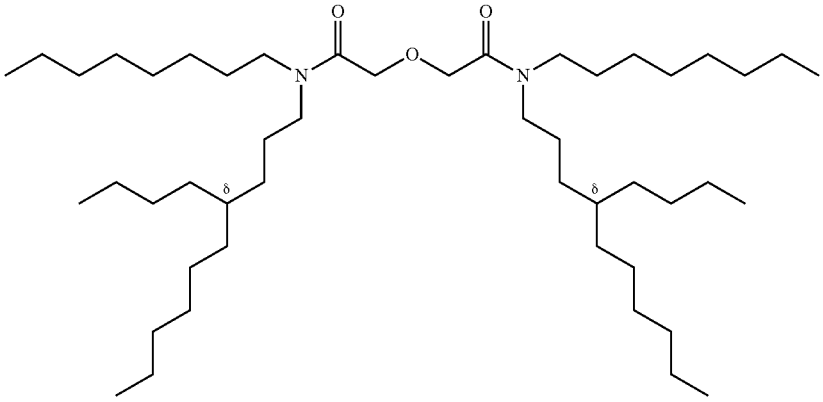
15
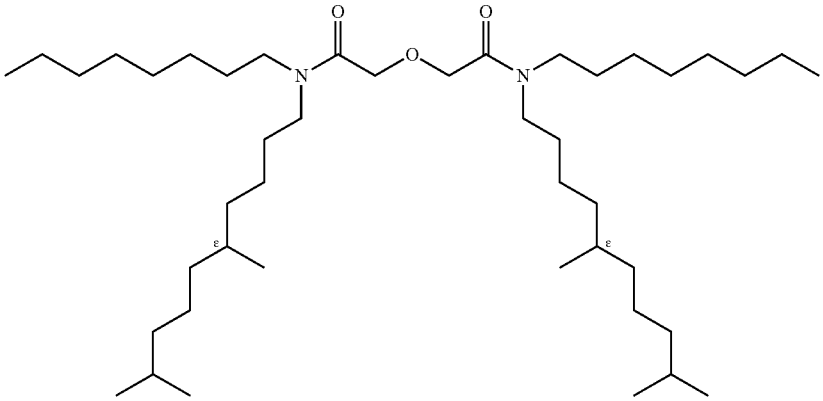
16
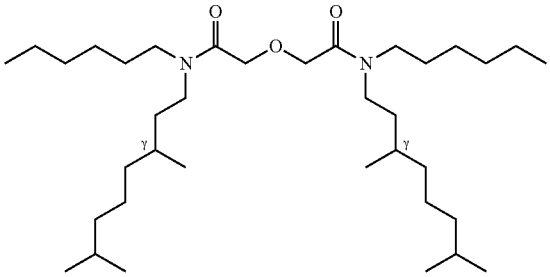

-continued
17
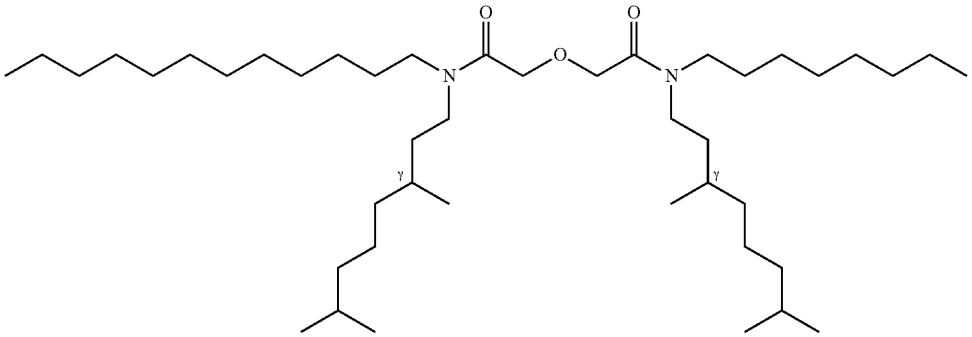
18
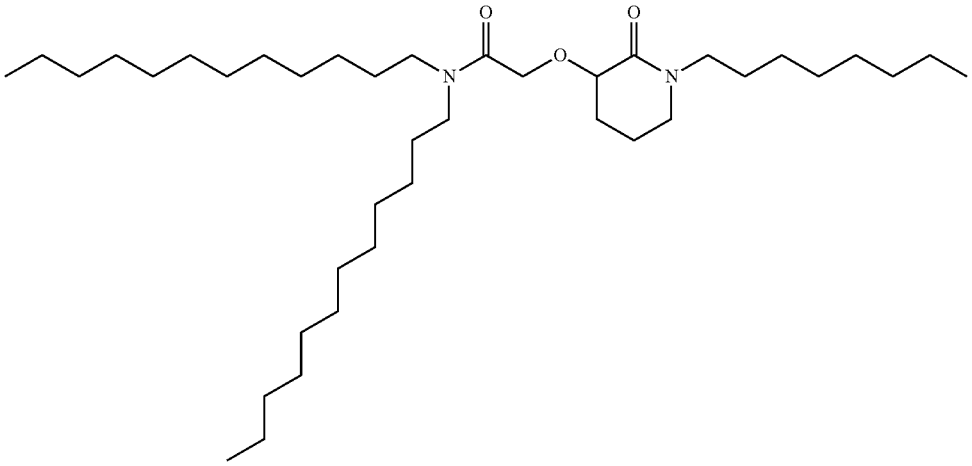
19
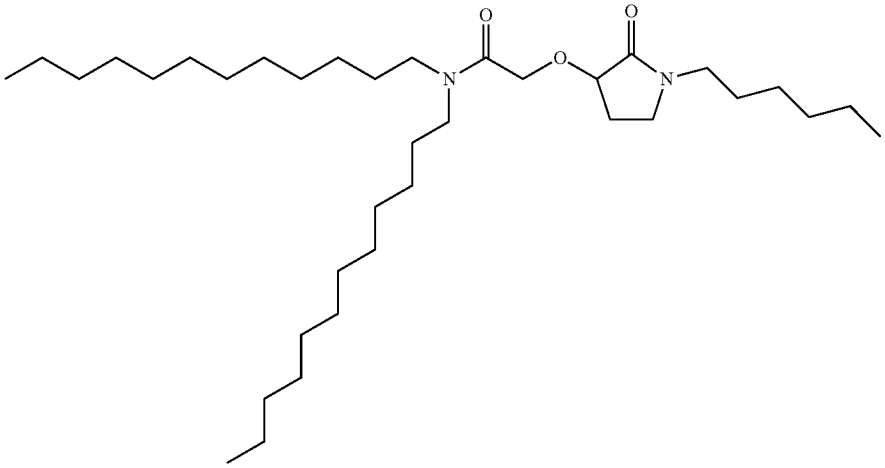
20
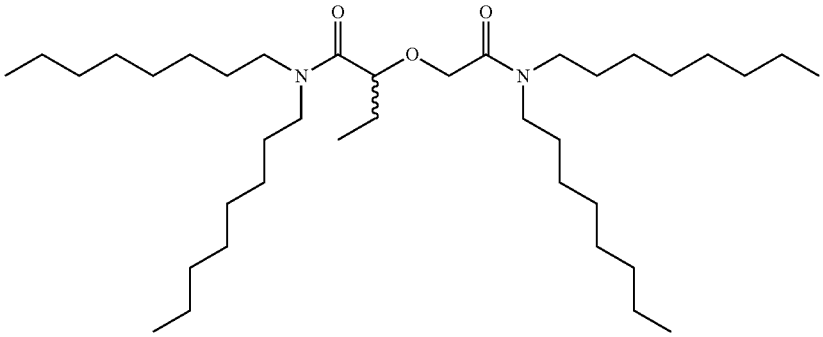

The compounds according to Formulas (2), (2a), (2b), (2c), and (2a-1) and sub-formulas thereof can be synthesized by methods well known in the art. Reference is made to, for example, D. D. Dicholkar et al., *Ind. Eng. Chem. Res.*, 52(7), 2457-2469, 2013, which describes the synthesis of N,N,N',N'-tetraoctyl-3-oxapentane-1,5-diamide (TODGA) in detail.

In some embodiments, the hydrophobic extractant solution, as described above, further includes an organoamine soluble in the aqueous-insoluble hydrophobic solvent. The organoamine may function to, for example, further bind to the REE, prevent or lessen formation of a third phase during the extraction, and/or assist in removing (stripping) the REE from the aqueous-insoluble hydrophobic solvent after extraction. To be soluble in the hydrophobic solvent, the organoamine should be sufficiently hydrophobic (lipophilic). To be sufficiently hydrophobic, the organoamine should contain at least one hydrocarbon group containing at least four carbon atoms. However, to ensure full solubility of the organoamine in the hydrophobic solvent, the organoamine preferably contains, in total, at least or more than six carbon atoms. In different embodiments, the organoamine may contain at least or more than, for example, 6, 7, 8, 9, 10, 11, 12, 13, 14, 15, 16, 17, 18, 19, or 20 carbon atoms, or a number of carbon atoms within a range bounded by any two of the foregoing values. The organoamine may be a primary, secondary, or tertiary amine. Some examples of primary organoamines include n-hexylamine, isohexylamine, n-heptylamine, n-octylamine, isooctylamine, n-nonylamine, n-decylamine, n-undecylamine, n-dodecylamine, n-tridecylamine, n-tetradecylamine, and n-hexadecylamine. Some examples of secondary organoamines include dibutylamine, diisobutylamine, dipentylamine, dihexylamine, diheptylamine, diooctylamine, dinonylamine, didecylamine, didodecylamine, N-methylbutylamine, N-methylpentylamine, N-methylhexylamine, N-methylheptylamine, N-methyloctylamine, N-ethylbutylamine, and N-ethyloctylamine. Some examples of tertiary organoamines include tributylamine, tripentylamine, trihexylamine, triheptylamine, trioctylamine, trinonylamine, tridecylamine, triundecylamine, and tridodecylamine. In some embodiments, any one or more of the above amines, or any amine altogether, is/are excluded from the hydrophobic extractant solution.

In some embodiments, the hydrophobic extractant solution, as described above, further includes an organoamide soluble in the aqueous-insoluble hydrophobic solvent. The organoamide may function to, for example, further bind to the REE, prevent formation of a third phase during the extraction, and/or assist in removing (stripping) the REE from the aqueous-insoluble hydrophobic solvent after extraction. To be soluble in the hydrophobic solvent, the organoamide should be sufficiently hydrophobic (lipophilic). To be sufficiently hydrophobic, the organoamide should contain at least one hydrocarbon group containing at least four carbon atoms. However, to ensure full solubility of the organoamide in the hydrophobic solvent, the organoamide preferably contains, in total, at least or more than six carbon atoms. In different embodiments, the organoamide may contain at least or more than, for example, 6, 7, 8, 9, 10, 11, 12, 13, 14, 15, 16, 17, 18, 19, or 20 carbon atoms, or a number of carbon atoms within a range bounded by any two of the foregoing values. Some examples of hydrophobic organoamides include N-methylpentanamide, N-ethylpentanamide, N-propylpentanamide, N-butylpentanamide, N-pentylpentanamide, N-hexylpentanamide, N-methylhexanamide, N-ethylhexanamide, N-propylhexanamide, N-methyloctanamide, N-ethyloctanamide, N-propyloctanamide, N-methyldecanamide, N-ethyldecanamide, N-propyldecanamide, N,N-dimethylpentanamide, N,N-diethylpentanamide, N,N-dipropylpentanamide, N,N-dibutylpentanamide, N,N-dihexylpentanamide, and N,N-diethyloctanamide. In some embodiments, any one or more of the above amides, or any amide altogether, is/are excluded from the hydrophobic extractant solution.

In some embodiments, the hydrophobic extractant solution, as described above, further includes an alcohol soluble in the aqueous-insoluble hydrophobic solvent. The alcohol generally functions to prevent or lessen formation of a third phase during the extraction. To be soluble in the hydrophobic solvent, the alcohol should be sufficiently hydrophobic (lipophilic). To be sufficiently hydrophobic, the alcohol typically contains at least or more than six carbon atoms. In different embodiments, the alcohol contains at least or more than, for example, 6, 7, 8, 9, 10, 11, 12, 13, 14, 15, 16, 17, 18, 19, or 20 carbon atoms, or a number of carbon atoms within a range bounded by any two of the foregoing values. Some examples of lipophilic alcohols include n-hexyl alcohol, 4-methyl-1-pentanol, n-heptanol, n-octanol, 6-methyl-1-heptanol, 2-ethyl-1-hexanol, n-decanol, n-dodecanol, n-tridecanol, isotridecanol, n-tetradecanol, and n-hexadecanol. In some embodiments, any one or more of the above alcohols, or any alcohol altogether, is/are excluded from the hydrophobic extractant solution.

In another aspect, the present disclosure is directed to a method for separating adjacent lanthanide elements by use of the above described hydrophilic phenanthroline compounds and lipophilic extractant compounds. The term "lanthanide element," as used herein, refers to those elements having an atomic number of 57-71. The lanthanide elements are listed as follows: lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu). The term "adjacent lanthanide elements" refers to lanthanide elements differing by one atomic number, such as Nd/Pr, Eu/Sm, Nd/Pm, or Tb/Gd pairs.

At least two adjacent lanthanide elements are present in an acidified aqueous solution. Aside from the two adjacent lanthanide elements, the acidified aqueous solution may or may not contain one, two, or more other lanthanide elements, and which may or may not be adjacent. In the acidified aqueous solution, the rare earth elements are present in ionic form (e.g., $Nd^{+3}$), which is typically a salt form (e.g., $Nd_2(SO_4)_3$) or complexed form. The acidified aqueous solution may or may not also contain at least one (or one or more) of any of the actinide elements, such as uranium (U) and/or thorium (Th).

In the acidified aqueous solution, at least a portion (or all) of the lighter lanthanide elements (i.e., from the pair of adjacent lanthanide elements) are complexed with the hydrophilic lanthanide complexing agent described earlier above, i.e., according to Formulas (1) and (1a). While hydrophilic lanthanide complexing agent selectively binds to lighter lanthanide elements in the acidified aqueous solution, the hydrophilic lanthanide complexing agent substantially does not bind to heavier lanthanide elements in the acidified aqueous solution. By selectively binding to lighter lanthanide elements, the hydrophilic lanthanide complexing agents function to retain (hold back) the complexed lighter element(s) in an aqueous phase when the aqueous phase is in contact with a hydrophobic (non-aqueous) extracting phase.

In the method, the acidified aqueous solution containing the lanthanide elements and hydrophilic lanthanide complexing agent is contacted with the hydrophobic solution containing the lipophilic lanthanide extractant compound dissolved in an aqueous-insoluble hydrophobic solvent. The dual action of the hydrophilic hold-back agent in the hydrophilic phase and the lipophilic extractant compound in the hydrophobic phase results in an exceptional selectivity (e.g., 2, 3, 4, or higher) for separation of adjacent lanthanide elements.

To produce the acidified aqueous solution, an aqueous source solution containing the two or more lanthanide elements is acidified with an inorganic acid (mineral acid) to result in an acidified aqueous solution containing the lanthanide elements and containing the inorganic acid in a concentration of 1-12 M. In different embodiments, the inorganic acid concentration of the aqueous source solution is precisely or about, for example, 1, 2, 3, 4, 5, 6, 7, 8, 9, 10, 11, or 12 M, or an inorganic acid concentration within a range bounded by any two of the foregoing values (e.g., 1-12 M, 2-12 M, 2-8 M, 2-6 M, 3-12 M, 1-8 M, 2-8 M, 3-8 M, 1-5 M, 2-5 M, 3-5 M, or 1-3 M), wherein the term "about" may correspond to ±50%, ±20%, or ±10% of any of the foregoing values. The inorganic acid may be, for example, a hydrohalide (i.e., HX, wherein X is typically Cl, Br, or I), sulfuric acid ($H_2SO_4$), nitric acid ($HNO_3$), or phosphoric acid ($H_3PO_4$). In some embodiments, one or more of the foregoing inorganic acids is excluded from the acidified aqueous source solution. In particular embodiments, the inorganic acid is nitric acid, hydrochloric acid, or hydrobromic acid, which may or may not be combined with another inorganic acid. The hydrophilic lanthanide complexing agent may be present in the acidified aqueous solution in any suitable concentration, typically a concentration of 1-100 mM, or more particularly, a concentration of 1-50 mM, 1-25 mM, 2-100 mM, 2-50 mM, 2-25 mM, 5-100 mM, 5-50 mM, or 5-25 mM.

In the separation process, the acidified aqueous source solution is contacted with the aqueous-insoluble hydrophobic solution containing a lipophilic lanthanide extractant compound, such as compound under Formula (2), or more particularly, a diglycolamide compound of Formula (2a-1). As noted earlier above, the lipophilic lanthanide extractant more selectively complexes with heavier lanthanide elements. The term "contacted" or "contacting," as used herein, in reference to contacting of the aqueous and organic phases, generally refers to an intimate mixing of the aqueous and organic phases so as to maximize extraction of one or more lanthanide elements from the aqueous phase to the organic phase. Methods of intimately mixing liquids are well known in the art. For example, the aqueous and organic phases may be placed in a container and the container agitated. In some embodiments, the liquids are intimately mixed by subjecting them to vortex mixing. Following mixing, the two phases can be separated by means well known in the art, such as by standing or centrifugation. The foregoing process amounts to an efficient liquid-liquid extraction process whereby one or more heavier lanthanide elements in the acidified aqueous solution is/are selectively extracted into the aqueous-insoluble hydrophobic solvent (organic phase) while leaving one or more lighter lanthanide elements in the acidified aqueous solution.

The extraction process is capable of achieving a distribution coefficient (D), which may also herein be referred to as an extraction affinity, of at least 1 for one or more the lanthanide elements, wherein D is the concentration ratio of the rare earth element in the organic phase divided by its concentration in the aqueous phase. In some embodiments, a D value of greater than 1 is achieved, such as a D value of at least or above 2, 5, 10, 20, 50, 100, 150, 200, 250, 500, or 1000. The selectivity of the process can be characterized by the separation factor (SF), wherein SF is calculated as the ratio of D for two different ions, such as any two of the ions disclosed above, such as selectivity of a later lanthanide (e.g., Nd) relative to an adjacent earlier lanthanide (e.g., Pr), in which particular case $SF=D_{Nd}/D_{Pr}$. Selectivity is generally evident in an SF value greater than 1. In some embodiments, an SF value of at least or greater than 2, 3, 4, 5, 10, 20, 50, 100, 150, 200, 250, 500, or 1000 is achieved.

The method can separate adjacent lanthanide elements (denoted as Ln1 and Ln2 for heavier and lighter elements, respectively) with an Ln1/Ln2 selectivity of at least or greater than 2, 3, 4, 5, 6, 7, 8, 9, 10, 20, 30, 40, 50, 60, 70, 80, 90, or 100. Any adjacent lanthanide pair may be separated according to any of the foregoing selectivities. The adjacent lanthanide pair(s) may be, for example, Ce/La, Pr/Ce, Nd/Pr, Sm/Pm, Eu/Sm, Gd/Eu, Tb/Gd, Dy/Tb, Ho/Dy, Er/Ho, Tm/Er, Yb/Tm, and/or Lu/Yb pairs. One or more of the lanthanide elements may be radioisotopes, such as those useful in medical imaging, diagnostics, or therapy. Some examples of lanthanide radioisotopes include Tb-149, Lu-177, 153-Sm, 153-Gd, 141-Ce, and 166-Ho.

In some embodiments, the extraction method described above further includes a lanthanide removal step from the hydrophobic solution, aqueous solution, or both. To remove one or more lanthanides from the hydrophobic solution, the hydrophobic solution may be contacted with an aqueous stripping solution containing at least one inorganic acid, such as any of the inorganic acids described above, wherein the inorganic acid is typically present in a concentration of no more than 4 M (e.g., 0.5, 1, 2, or 3 M). Generally, the concentration of inorganic acid in the aqueous stripping solution is at least 0.5 M less (or at least 1 M, 1.5 M, 2 M, 3 M, or 4 M less) than the concentration of inorganic acid in the aqueous source solution in step (i). To remove one or more lanthanides from the aqueous solution, ammonium bicarbonate may be added to the aqueous solution to induce precipitated of the one or more lanthanides.

Examples have been set forth below for the purpose of illustration and to describe certain specific embodiments of the invention. However, the scope of this invention is not to be in any way limited by the examples set forth herein.p

EXAMPLES

Overview

The following experiments investigated the performance of a synergistic separation system that employs $_{aq}$BLPhen (a specific hydrophilic lanthanide complexing agent) and a lipophilic diglycolamide (DGA) extractant compound. The $_{aq}$BLPhen (in acidic aqueous phase) is more selective for binding to lighter lanthanide elements while the DGA extractant molecule (in hydrophobic phase) is more selective for binding to heavier lanthanide elements. The opposing selectivities of $_{aq}$BLPhen and DGA molecules resulted in an exceptional level of separation between adjacent lanthanide (Ln) elements.

The structure of $_{aq}$BLPhen (1) is provided as follows:
1
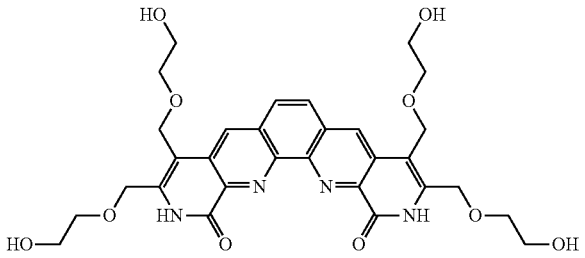
$_{aq}$BLPhen
The structure of a control (2) based on $_{aq}$BLPhen is provided as follows:
2
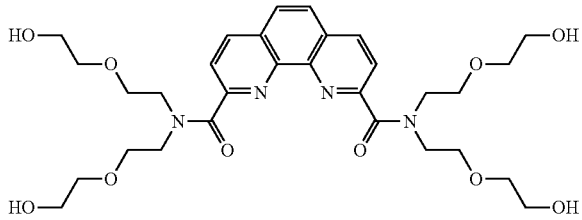
The structure of some DGA molecules studied include:
3
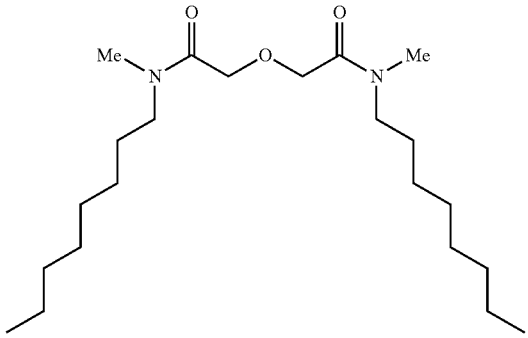
DMDODGA
4
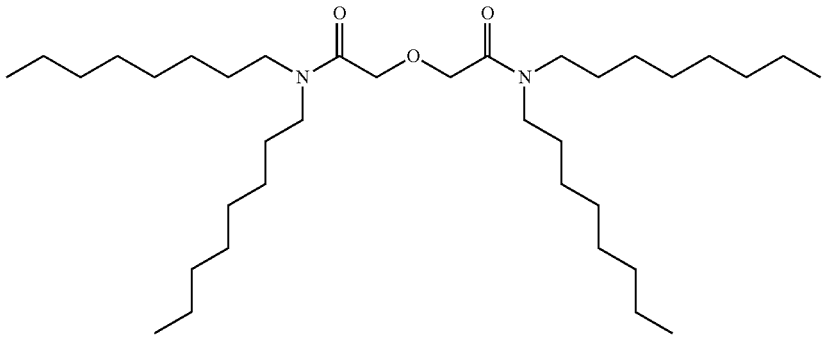
TODGA -continued

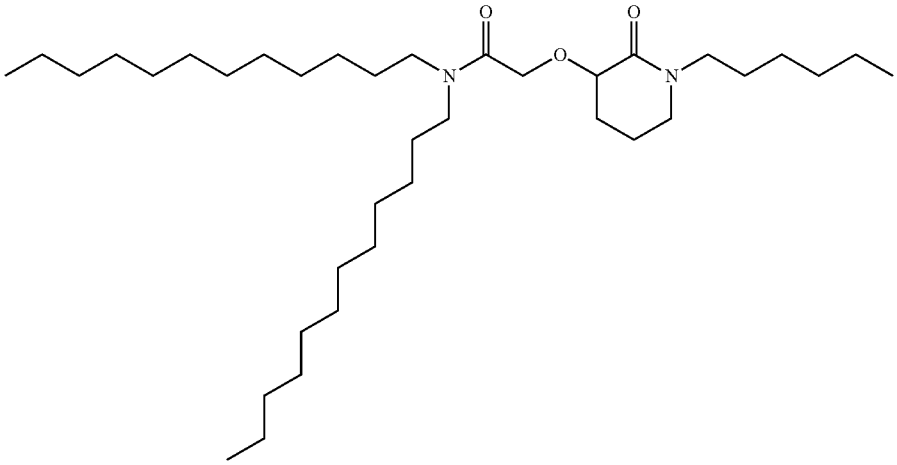

DDHPA

Synthesis of Ligands $_{aq}$BLPhen (1) was synthesized according to the following general scheme:

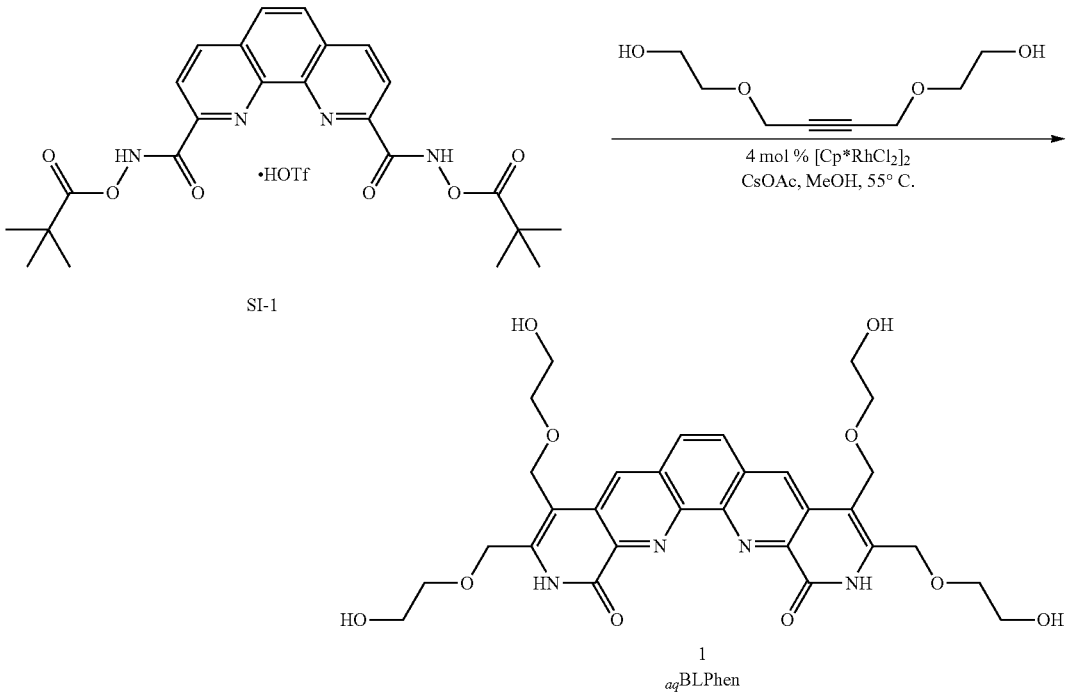

As shown by the above scheme, water-solubilizing ethylene glycol units were introduced in 1 via rhodium catalyzed C—H annulation reaction using 1,4-bis(2-hydroxyethoxy)-2-butyne as a reagent.

For the synthesis of 3,4,9,10-tetrakis((2-hydroxyethoxy)methyl)-2,11-dihydrodipyrido[3,4-b:4',3'-j]1,10 phenanthroline-1,12-dione ($_{aq}$BLPhen, 1), a solution of $N^2$,$N^9$-bis(pivaloyloxy)-1,10-phenanthroline-2,9-dicarboxamide (SI-1, 5 g, 10.7 mmol, 1.0 equiv), 2,2'-(but-2-yne-1,4-diylbis(oxy))bis(ethan-1-ol) (3.6 mL, 23.5 mmol), CsOAc (8.2 g, 42.8 mmol), and Rh catalyst (4 mol %, 265 mg) in MeOH (55 mL) was heated at 55° C. for 24 h. Afterward, the reaction mixture was allowed to cool to room temperature and EtOAc was added to precipitate the crude product. The precipitate was filtered and washed with EtOAc, $CH_2C_{12}$, and $Et_2O$. The dried solid was dissolved in minimal DI water and transferred to a pre-column loaded with Celite. The product was purified on a CombiFlash Rf automated flash chromatography system using reverse phase RediSepRf Gold C-18 Aq 450-g column as a stationary phase and gradient 0-60% (5-15 min) MeOH in $H_2O$ as an eluent. The product was obtained as a yellow solid (3.5 g, 53% yield).

$^1$H NMR (400 MHz, TFA-dl): δ 9.58 (s, 2H), 8.34 (s, 2H), 5.04 (s, 2H), 5.02 (s, 4H), 4.15-3.87 (m, 18H). $^{13}$C NMR (100.67 MHz, $D_2O$): δ 164.3, 140.6, 135.2, 134.4, 132.8, 131.3, 118.2, 115.3, 112.3, 75.3, 74.6, 68.8, 63.7. HR-MS $C_{30}H_{34}N_4O_{10}$ ([M+H]$^+$, m/z): 611.2357 (exp.), 611.2348 (calcd).

The solubility of 1 in 0.9 M nitric acid ($HNO_3$) is >0.2 M. The three DGAs selected for this study were: N,N'-dimethyl-N,N'-di(n-octyl)diglycolamide (DMDODGA, 3), N,N,N',N'-tetra(n-octyl)diglycolamide (TODGA, 4), and N,N-didodecyl-2-((1-hexyl-2-oxopiperidin-3-yl)oxy)acetamide (DDHPA, 5), whose structures are shown above. All three DGAs show comparable nonlinear ascending trends in selectivity from La to Lu. However, they differ in terms of binding affinity for lanthanides in the order 3>4>5. The stability of DGA-Ln complexes is affected by the size of N-alkyl substituents on the DGA ligand; larger substituents tend to obstruct the metal ion binding site that is decorated with three oxygen donor groups, resulting in diminished affinity for Lns with lower effective nuclear charge. Ligand 2, with unconstrained amide groups, was synthesized as a control substrate.

Separation Experiments

General procedure: a 500 microliter (μL) aqueous phase consisting of 7 mM Ln(III) (0.5 mM of each Ln(III)) in 1 M $HNO_3$ without or with $_{aq}$BLPhen 1 (3, 13, or 25 mM) was contacted with an equal volume of organic phase containing 0.1 M DGA (3, 4, or 5). The two phases were contacted in a 1:1 ratio of organic/aqueous by end-over-end rotation in individual 1.8 mL capacity snap-top Eppendorf tubes using a rotating wheel in an airbox set at 25.5±0.5° C. Contacts were performed in triplicate with a contact time of 1 hour. The samples were centrifuged at 1811 g for 2 min at room temperature to separate the phases. Each triplicate was then sub-sampled, using a 300 μL aliquot of the aqueous phase transferred to individual polypropylene tubes and diluted with 2% $HNO_3$ for analysis using ICP-MS or ICP-OES. Two samples of the initial lanthanide solution were similarly prepared.

The ability of 1 and DGA to separate Lns was evaluated using a two-component, immiscible solvent system: nitric acid (aqueous phase containing 1) and n-dodecane with 10 vol % 1-octanol (oil phase containing DGA). The amount of Ln partitioned from the aqueous phase into the oil phase was measured using inductively coupled plasma optical emission spectroscopy or mass spectrometry. The Ln concentration in each phase was then used to calculate the separation efficiency.

The percentage of Lns in the aqueous and the oil phases is presented in FIGS. 1*a*-1*i*. for each DGA in the absence and presence of the aqueous complexant 1 ($E=([Ln_1]/[Ln_1]_0)\times 100\%$). The distribution ratios (i.e., $D=[Ln_1]_{org}/[Ln_1]_{aq}$) for select Lns are listed in Table 1, which also include selectivities (i.e., $SF_{Ln1/Ln2}=D_{Ln1}/D_{Ln2}$), for several Ln pairs. An efficient separation of Lns was achieved when $D_{Ln1}>1$ and $D_{Ln2}<1$ or $E_{Ln1}>50\%$ and $E_{Ln2}<50\%$. The separation of 14 Lns (0.5 mM each, 7 mM total concentration) using 0.1 M of Ligands 3-5 alone is shown in FIG. 1*a*-1*c*. Ligand 3 (DMDODGA) nearly quantitatively extracted all Lns from the aqueous phase into the oil phase. Ligand 4 (TODGA) showed reduced affinity for light Lns, which is further pronounced using ligand 5 (DDHPA). Neither of the three DGAs can separate Lns in a single extraction stage.

TABLE 1

Distribution ratios and separation factors for selected Lns.

| | [1], mM | $D_{La}$[a] | $D_{Nd}$[a] | $D_{Sm}$[a] | $D_{Gd}$[a] | $SF_{Nd/Pr}$[a] | $SF_{Sm/Nd}$[a] | $SF_{Tb/Gd}$[a] | $SF_{Dy/Nd}$[a] | $SF_{Gd/La}$[a] |
|---|---|---|---|---|---|---|---|---|---|---|
| 3 | 0 | 71 | 558 | 1795 | 2531 | 2.1 | 3.2 | 1.1 | 4.7 | 36 |
| | 3 | 0.59 | 11.0 | 222 | 1192 | 4.0 | 20 | 2.0 | 352 | 2010 |
| | 13 | 0.28 | 10.7 | 68.1 | 552 | 4.2 | 6.4 | 3.0 | 451 | 1992 |
| | 25 | 0.23 | 2.34 | 42.2 | 346 | 3.2 | 18 | 3.0 | 1313 | 1512 |
| 4 | 0 | 2.52 | 18.6 | 120 | 386 | 2.2 | 6.4 | 2.7 | 70 | 153 |
| | 3 | 0.21 | 2.18 | 28.1 | 164 | 2.7 | 13 | 3.4 | 408 | 783 |
| | 13 | 0.05 | 0.15 | 2.35 | 19.3 | 2.2 | 16 | 5.4 | 1052 | 413 |
| | 25 | 0.05 | 0.14 | 1.82 | 14.2 | 1.8 | 13 | 5.3 | 782 | 308 |
| 5 | 0 | 0.18 | 0.87 | 6.21 | 23.0 | 2.0 | 7.2 | 3.3 | 130 | 128 |
| | 3 | 0.12 | 0.32 | 2.53 | 13.4 | 1.8 | 8.0 | 3.7 | 260 | 109 |
| | 13 | 0.08 | 0.08 | 0.16 | 0.98 | 0.9 | 2.0 | 5.1 | 133 | 12 |
| | 25 | 0.06 | 0.07 | 0.17 | 0.88 | 1.0 | 2.5 | 5.8 | 123 | 14 |
| 3 | 13[b] | 2.65 | 21.4 | 163 | 360 | 2.3 | 7.6 | 1.6 | 60 | 136 |

[a]Average value of 3 experiments. D = distribution value; $D_{Ln1}=[Ln1]_{org}/[Ln2]_{aq}$. SF = separation factor; $SF_{Ln1/Ln2}=D_{Ln1}/D_{Ln2}$.
[b]Ligand 2 used instead of ligand 1.

The introduction of water-soluble ligand 1 (3 mM) in the aqueous phase results in lower partitioning of light Lns to the oil phase containing Ligands 3, 4, 5 (FIGS. 1*d*, 1*e*, and 1*f*, which dramatically changes the selectivity trends across the Ln series. The results show that 1 preferentially binds light Lns and that the extent of Lns retained in the aqueous phase correlates with the change in affinity of DGA for trivalent Lns. The higher concentration of 1 in the aqueous phase (13 mM, FIGS. 1, 1*h*, and 1*i*) further amplifies the selectivity between light and heavy Lns. This two-ligand system yields an efficient separation of light from heavy Lns in a single extraction stage. For example, La—Ce is separated from Tb—Lu (FIG. 1*h*) and La—Nd from Ho—Lu (FIG. 1*i*). Furthermore, an improved separation is demonstrated among the mid-lanthanides. For example, the combination of 1 and Ligand 5 yields an improved selectivity in separating adjacent lanthanides Gd and Tb ($SF_{Tb/Gd}=5.8$, Table 1). The selectivity of 16 is observed when separating Sm and Nd using 1 and Ligand 4. This system offers a potential strategy to separate radioactive Pm from Sm and Nd. The combination of 1 and Ligand 3 outperforms the TODGA-DOODA($C_2$) and TDdDGA-DOODA($C_2$) systems and results in 20 and nearly 2 times higher selectivity for Gd over La, respectively (Table 1). An increased concentration of 1 (25 mM) results in minimal change separating Lns (Table 1), suggesting that the system is at its limit and 1 no longer has the ability to outcompete DGA in complexing heavier lanthanides.

Figure 2:
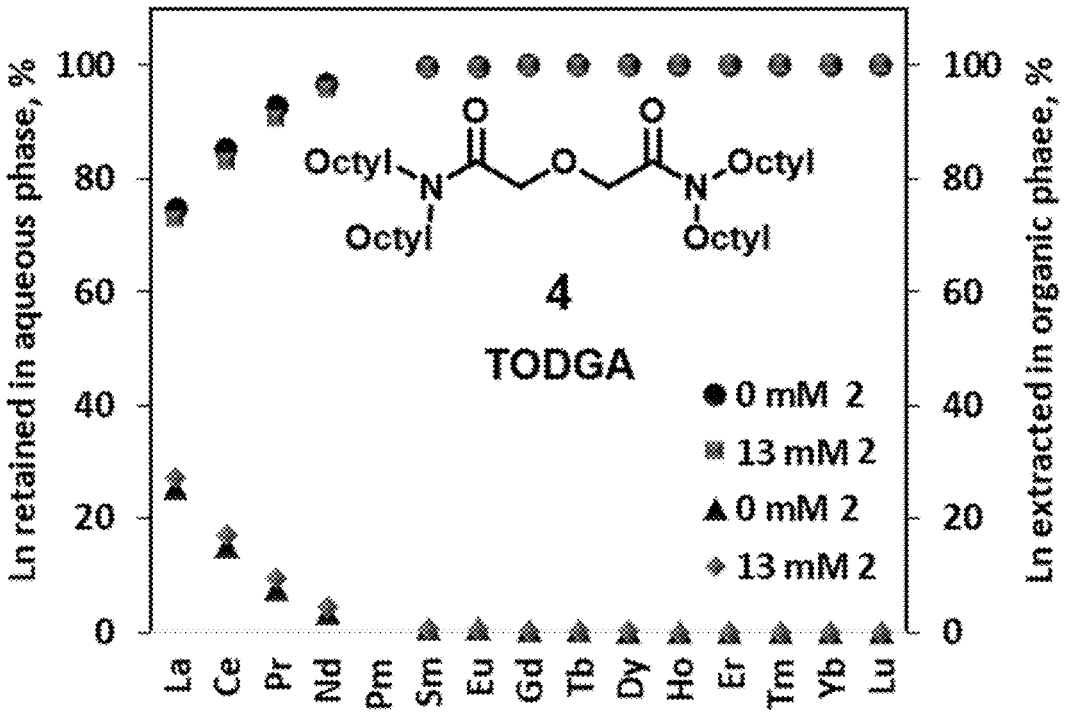
FIG. 2 is a graph showing variation in the extraction of 14 Lns (excluding Pm), 0.5 mM each, with 0.1 M Ligand 4 (TODGA) from 1 M $HNO_3$ into n-dodecane with 10 vol % 1-octanol at 25.5±0.5° C. after 1 h in the absence (0 mM) and presence of 13 mM of control Ligand 2.

Like 1, Ligand 2 shows excellent aqueous solubility. However, its performance in separating Lns is very different. As depicted in FIG. 2, even at 13 mM concentration, Ligand 2 shows limited affinity for light lanthanides, which is attributed to the larger reorganization energy required to complex with Ln in contrast to a preorganized ligand 1.

Figures 3A, 3B, 3C:
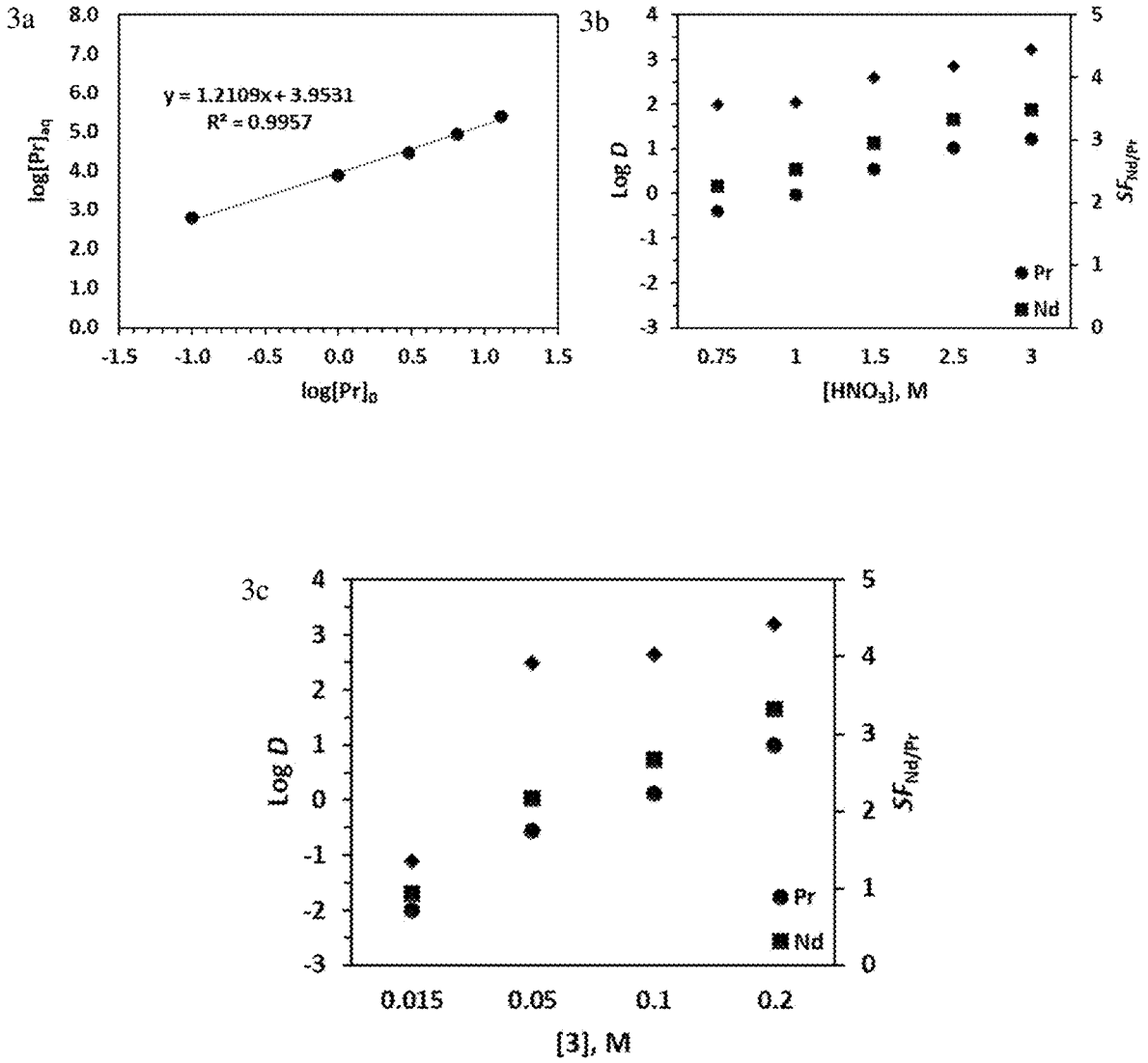
FIGS. 3*a*-3*c*.

The synergistic use of 1 and Ligand 3 was further optimized to maximize the separation of one adjacent Ln pair Nd—Pr using the percentage of Ln extracted as a guide. The separation of Nd and Pr reached equilibrium in less than 1 hour, and the D values for both increased at higher $HNO_3$ and Ligand 3 concentrations (FIGS. 3*b* and 3*c*). Ligand 3, being a neutral ligand, requires co-extraction of counterions (i.e., three $NO_3^-$) with Ln; thus, the extraction of Lns with DGA is favored at high nitrate concentration, and the process is reversed at low anion concentration. The increase in log D at a higher concentration of Ligand 3 indicates that Ligand 3 has high affinity for all Ln(III) and that improved separation of Lns can be attained either by lowering its concentration or by increasing that of 1.

The highest selectivity of 4.9±0.2 for Nd—Pr pair was obtained when separating 2.5 mM Nd and Pr, each using 13 mM of 1 in 1 M $HNO_3$ with 0.1 M of Ligand 3 in the oil phase and equilibrating for 30 min at 25.5° C. Next, the recovery of Nd and Pr from each phase after extraction using the 1-Ligand 3-$HNO_3$ system was investigated. Near-quantitative recovery of Nd and Pr from the spent oil phase was obtained after three consecutive contacts with an equal volume of deionized water. The dissociation of Pr and Nd from the complexes with 1 in the aqueous phase was promoted by the addition of an equal volume of saturated ammonium carbonate, which resulted in the precipitation of Ln carbonate salts. The charged ligand ($CO_3^{2-}$) outcompetes neutral ligand 1 in complexing with Ln ions; furthermore, the thermodynamics of the $Ln_2(CO_3)_3$ formation is highly favorable due to high crystal lattice energy of the salt. The identity of the precipitate was confirmed using Fourier-transform infrared spectroscopy (FTIR), and the results are in good agreement with commercially available Pr and Nd carbonate salts. Ligand 1 remains in the aqueous solution that can be further recycled in the lanthanide separation process.

Spectroscopic Studies

Figure 4:
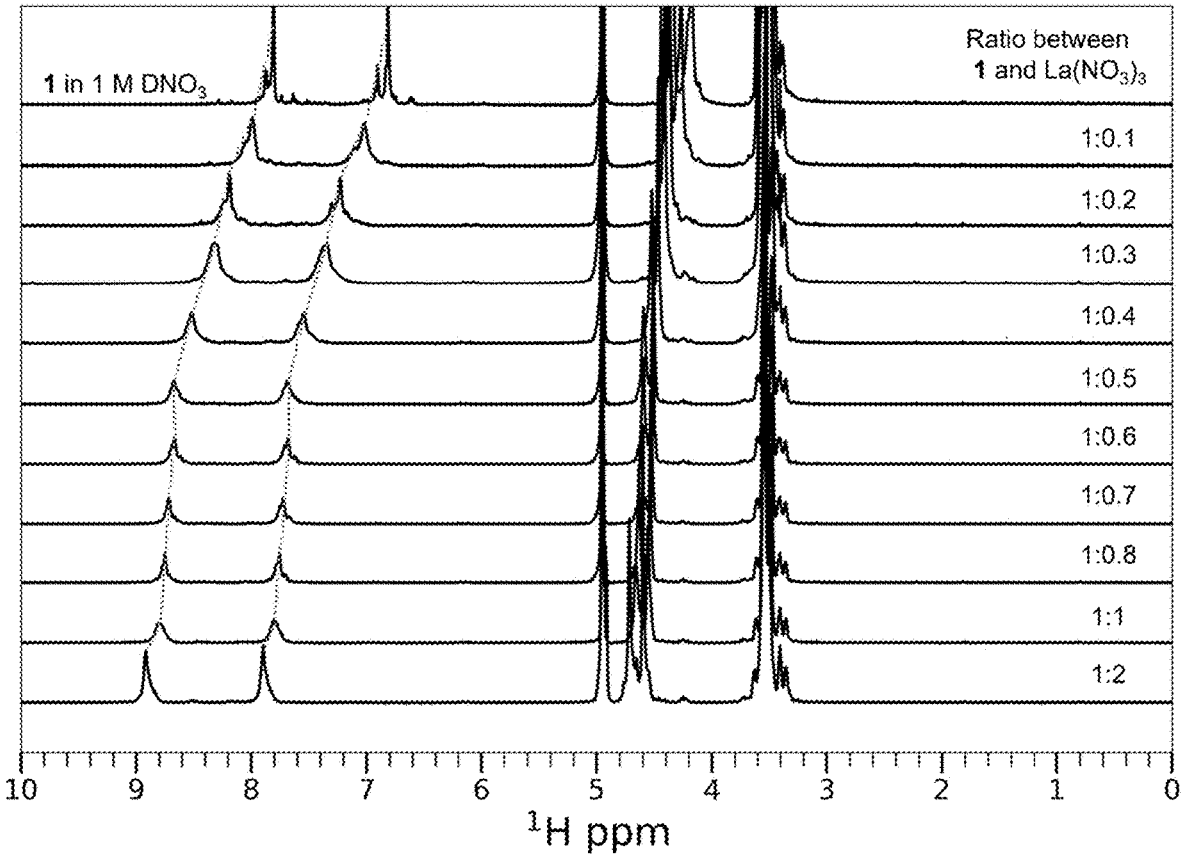
FIG. 4 shows an overlay of $^1H$ NMR spectra for Ligand 1 in 1 M $DNO_3$ in $D_2O$ without and with increasing amounts of $La(NO_3)_3$ (top to bottom).

Complexation of 1 with lanthanides was further assessed using nuclear magnetic resonance (NMR) spectroscopy. FIG. 4 shows the $^1H$ NMR data for 1 with various concentration ratios of La. As the concentration of La increases (top to bottom), a downfield shift of ~1.1 ppm occurs in the most downfield aromatic $^1H$ of 1, confirming complex formation. In addition, as the concentration of La increases, the spectral lines become increasingly uniform and narrow, which suggests the formation of well-defined species. For 1 alone, some heterogeneity and broadening in the peak structure is observed, which can be attributed to aggregate formation. While the ethylene glycol units solubilize 1, the hydrophobic cores still cluster together to form aggregate structures (vide infra). As the La concentration increases, it disrupts these clusters and stabilizes 1-La units. The change in chemical shift of the most downfield aromatic $^1H$ was used to assess binding constants for La complexes with 1 in 1 M $DNO_3$. The results were fitted using commercial software to yield binding constants of $K1>10^2$ $M^{-1}$ and $K2>>10^5$ $M^{-1}$ for the 1:1 and 2:1 ligand to metal binding modes, respectively. A more significant ~3 ppm chemical shift change was observed for Pr, which is likely due to differences in the magnitude of the pseudo-contact shifts; however, the narrowing with increased Pr concentration was similar, which is suggestive of a well-defined chelation. In the Lu titration, some downfield shift was observed, but the peaks became increasingly heterogenous and broad. This may be attributed to poor binding affinity where transient interactions occur, but no stable structure was formed, which was consistent with the selectivity data presented above.

Figure 5A:
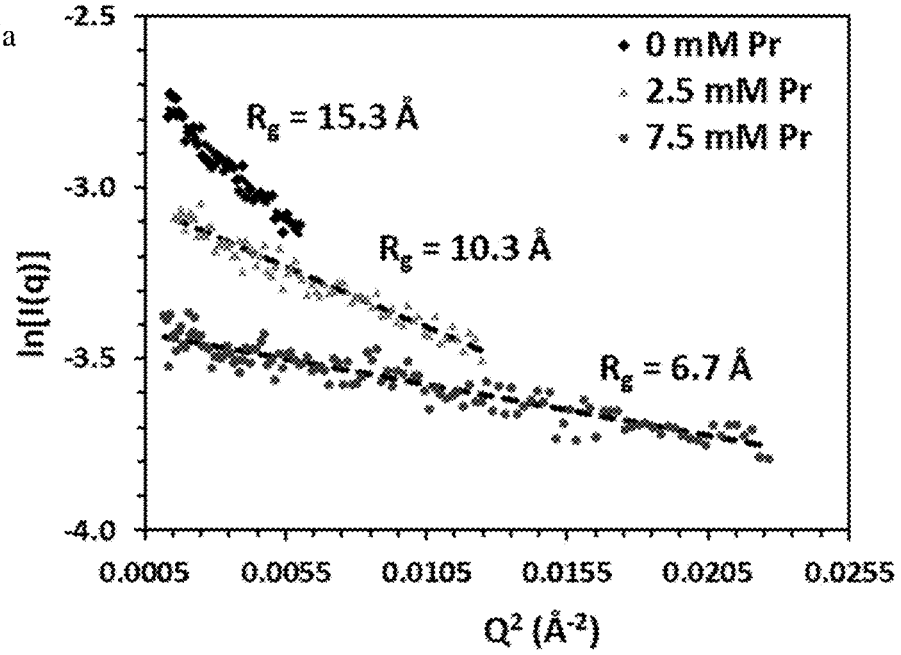
FIGS. 5*a*-5*b*.

The mesoscale structure of 1 and 1-Pr complexes in the aqueous solution and the local coordination environment around Pr in the 1-Pr structure were investigated using small-angle X-ray scattering (SAXS) and extended X-ray absorption fine structure (EXAFS) spectroscopy at the Pr L3 edge, respectively. In the absence of Pr, 13 mM of 1 in 1 M $HNO_3$ forms large aggregates with a radius of gyration ($R_g$) of ~15 A, as represented by the steepest slope in FIG. 5*a*. The addition of smaller amounts of Pr (2.5 mM) reduces the aggregate size in solution by ~5 A.

Under conditions where 1 is expected to be fully coordinated with Pr (assuming the formation of $[Pr\text{-}(1)_2(NO_3)_3]$, when [Pr]=7.5 mM), the aggregates further reduce in size ($R_g$=6.7 A). This is consistent with the trends seen in the NMR data above. In addition, variable temperature NMR was taken of 1 without and with Pr. At elevated temperatures (up to 313 K), the spectral quality of 1 degrades dramatically and is irreversible, which is indicative of additional aggregate formation in solution. In the presence of Pr, however, the $^1H$ chemical shifts representing 1 remain unchanged and the peaks narrow due to increased molecular motion. The trend is reversible, which suggests that the complexed species are stable.

Figure 5B:
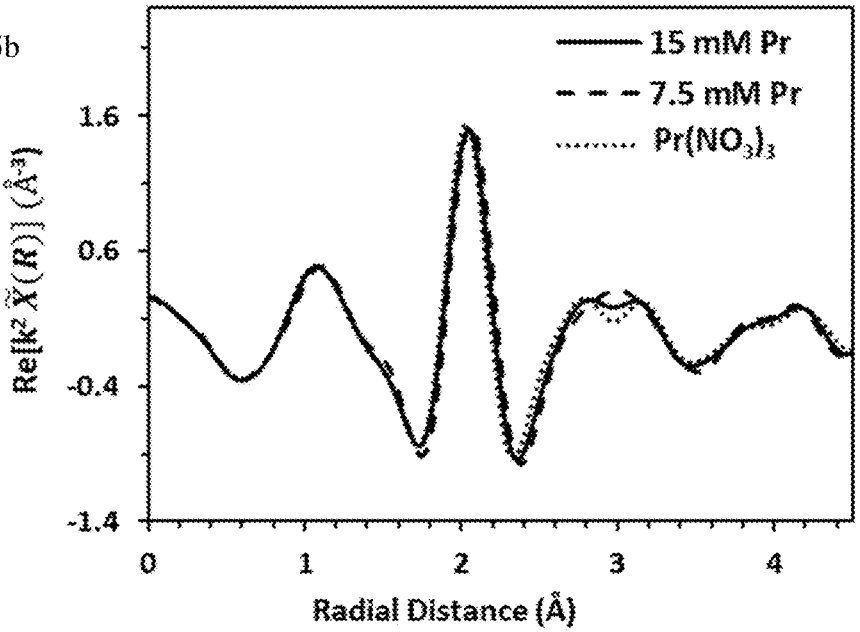

The EXAFS measurements provide an element-specific probe of Pr complexation with 1 in 1 M $HNO_3$. In this experiment, the Pr aqua complex in the aqueous phase was used as a control (FIG. 5*b*). Upon introduction of 1 in the Pr solution, a clear change in the average $1^{st}$ coordination shell bond distance between Pr and nitrogen/oxygen donor atoms in 1 is observed. Through fitting the EXAFS data to an individual Pr—O scattering path, it was found that the average 1st shell bond distance increases by 0.06 and 0.04 Å under conditions where 2:1 (dashed line) or 1:1 (solid line) complexes exist between 13 mM of 1 and Pr (7.5 and 15 mM). The calculated distances are likely an average of both Pr—O and Pr—N photoelectron scattering due to the restricted k-window of the Pr L3-edge (2.4-9.2 $Å^{-1}$) and consistent with previously measured crystal structures on analogous Pr—BLPhen complexes (S. Jansone-Popova et al., *Inorg. Chem.,* 56, 5911-5917, 2017).

Furthermore, the complementary density functional theory (DFT) calculations indicate a slight shortening of the inner-shell average bond distance on going from 2:1 to 1:1 ligand/metal complexation at higher Pr loading, which is in agreement with the speciation description obtained from our EXAFS results. These observations, in addition to the slope analysis (FIG. 3*a*) suggest that 1:1 and 2:1 1-Pr complexes readily form in solution, consistent with improved selectivity of 1 toward light lanthanides.

CONCLUSIONS

In conclusion, an efficient and selective lanthanide separation was demonstrated using a two-ligand system. The synergistic interplay between neutral lipophilic and hydrophilic ligands with opposing Ln selectivity led to unprecedented separation profiles for adjacent Lns. Furthermore, the separation of specific Ln pairs can be achieved by selecting a DGA with optimal affinity. The solution structure investigations using solvent extraction and SAXS, NMR, and EXAFS spectroscopies provided useful insights into the speciation of Ln-$_{aq}$BLPhen complexes. The high affinity of 1 for light Lns does not hamper their recovery; however, further optimization is needed to develop a continuous Ln separation cycle.

While there have been shown and described what are at present considered the preferred embodiments of the invention, those skilled in the art may make various changes and modifications which remain within the scope of the invention defined by the appended claims.

What is claimed is:

1. A lanthanide complexing molecule having the formula:

(1)

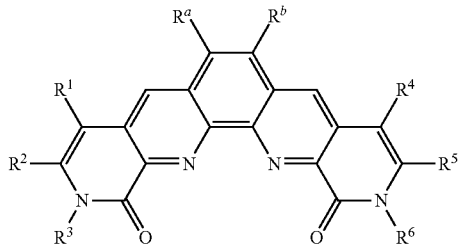

wherein:

$R^1$, $R^2$, $R^4$, and $R^5$ are independently selected from hydrogen atom, alkyl groups containing 1-3 carbon atoms, and hydrophilic groups containing at least one oxygen atom; wherein optionally, $R^1$ and $R^2$ may interconnect to form a ring and/or $R^4$ and $R^5$ may interconnect to form a ring;

$R^3$ and $R^6$ are independently selected from hydrogen atom, alkyl groups containing 1-3 carbon atoms, and hydrophilic groups containing at least one oxygen atom; and $R^a$ and $R^b$ are independently selected from hydrogen atom, methyl group, halogen atoms, and hydrophilic groups containing at least one oxygen atom;

wherein at least two of $R^1$, $R^2$, $R^3$, $R^4$, $R^5$, $R^6$, $R^a$, and $R^b$ are said hydrophilic groups.

2. The molecule of claim 1, wherein at least four of $R^1$, $R^2$, $R^3$, $R^4$, and $R^6$ are said hydrophilic groups.

3. The molecule of claim 1, wherein said hydrophilic groups are selected from the group consisting of hydroxy-containing groups, ether-containing groups, groups containing both hydroxy and ether groups, carboxylic acid groups, sulfonic acid groups, and nitro groups.

4. The molecule of claim 1, wherein at least two of $R^1$, $R^2$, $R^3$, $R^4$, $R^5$, and $R^6$ have the formula —$(CH_2CH_2O)_n$—$CH_2CH_2OH$, wherein n is 0-6.

5. The molecule of claim 4, wherein n is 1-6.

6. The molecule of claim 1, wherein at least four of $R^1$, $R^2$, $R^3$, $R^4$, $R^5$, and $R^6$ have the formula —$(CH_2CH_2O)_n$—$CH_2CH_2OH$, wherein n is 0-6.

7. The molecule of claim 6, wherein n is 1-6.

8. The molecule of claim 1, wherein the molecule has the formula:

(1a)

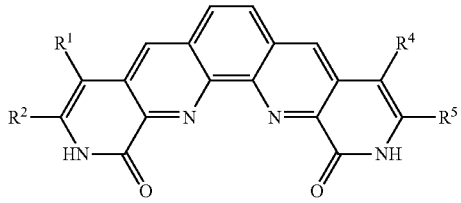

wherein:

$R^1$, $R^2$, $R^4$, and $R^5$ are independently selected from hydrogen atom and hydrophilic groups containing at least one oxygen atom, wherein at least two of $R^1$, $R^2$, $R^4$, and $R^5$ are said hydrophilic groups.

9. The molecule of claim 8, wherein at least two of $R^1$, $R^2$, $R^4$, and $R^5$ have the formula —$(CH_2CH_2O)_n$—$CH_2CH_2OH$, wherein n is 0-6.

10. The molecule of claim 9, wherein n is 1-6.

11. The molecule of claim 8, wherein each of $R^1$, $R^2$, $R^4$, and $R^5$ has the formula —$(CH_2CH_2O)_n$—$CH_2CH_2OH$, wherein n is 0-6.

12. The molecule of claim 11, wherein n is 1-6.

13. A method for separating adjacent lanthanide elements, the method comprising:

(i) providing an acidified aqueous solution containing adjacent lanthanide elements complexed with a hydrophilic lanthanide complexing agent having the formula:

(1)

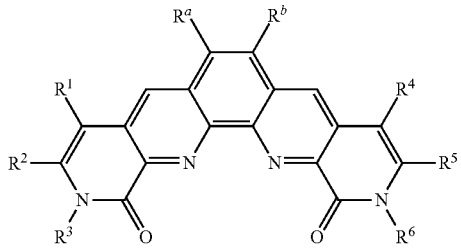

wherein:

$R^1$, $R^2$, $R^4$, and $R^5$ are independently selected from hydrogen atom, alkyl groups containing 1-3 carbon atoms, and hydrophilic groups containing at least one oxygen atom; wherein optionally, $R^1$ and $R^2$ may interconnect to form a ring and/or $R^4$ and $R^5$ may interconnect to form a ring;

$R^3$ and $R^6$ are independently selected from hydrogen atom, alkyl groups containing 1-3 carbon atoms, and hydrophilic groups containing at least one oxygen atom; and $R^a$ and $R^b$ are independently selected from hydrogen atom, methyl group, halogen atoms, and hydrophilic groups containing at least one oxygen atom;

wherein at least two of $R^1$, $R^2$, $R^3$, $R^4$, $R^5$, $R^6$, $R^a$, and $R^b$ are said hydrophilic groups;

wherein said hydrophilic lanthanide complexing agent according to Formula (1) complexes more strongly with lighter lanthanide ions compared to heavier lanthanide ions and thereby more strongly retains lighter lanthanide ions in the acidified aqueous solution compared to heavier lanthanide ions;

(ii) contacting the acidified aqueous solution with an aqueous-insoluble hydrophobic solution comprising a lipophilic lanthanide extractant compound dissolved in an aqueous-insoluble hydrophobic solvent, wherein said lipophilic lanthanide extractant compound complexes more strongly with heavier lanthanide ions compared to lighter lanthanide ions, to result in said lipophilic lanthanide extractant compound more selectively extracting one or more heavier lanthanide ions from the acidified aqueous solution into the hydrophobic solution.

14. The method of claim 13, wherein the lipophilic lanthanide extractant compound has the following structure:

X-L-Y (2)

wherein:

X and Y are independently selected from —C(O)$NR_2$ and —P(O)$R_2$, wherein R is independently selected, in each instance, from hydrocarbon groups containing 1-30 carbon atoms and optionally containing an ether or thioether linkage connecting between carbon atoms, provided that the total carbon atoms in X and Y combined is at least 12; and L is a linker containing at least one carbon atom.

15. The method of claim 14, wherein the lipophilic lanthanide extractant compound has the following structure:

(2a-1)

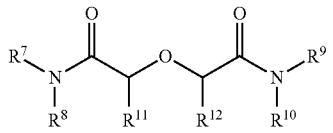

wherein:

$R^7$, $R^8$, $R^9$, and $R^{10}$ are independently selected from alkyl groups containing 1-30 carbon atoms and optionally containing an ether or thioether linkage connecting between carbon atoms, provided that the total carbon atoms in $R^7$, $R^8$, $R^9$, and $R^{10}$ is at least 12; and $R^{11}$ and $R^{12}$ are independently selected from hydrogen atom and alkyl groups containing 1-3 carbon atoms;

wherein $R^8$ and $R^{11}$ optionally interconnect to form a lactam ring, and/or $R^{10}$ and $R^{12}$ optionally interconnect to form a lactam ring.

16. The method of claim 13, wherein at least four of $R^1$, $R^2$, $R^3$, $R^4$, $R^5$, and $R^6$ are said hydrophilic groups.

17. The method of claim 13, wherein said hydrophilic groups are hydroxy-containing groups, ether-containing groups, or groups containing both hydroxy and ether groups.

18. The method of claim 13, wherein at least two of $R^1$, $R^2$, $R^3$, $R^4$, $R^5$, and $R^6$ have the formula —$(CH_2CH_2O)_n$—$CH_2CH_2OH$, wherein n is 0-6.

19. The method of claim 18, wherein n is 1-6.

20. The method of claim 13, wherein at least four of $R^1$, $R^2$, $R^3$, $R^4$, $R^5$, and $R^6$ have the formula —$(CH_2CH_2O)_n$—$CH_2CH_2OH$, wherein n is 0-6.

21. The molecule of claim 20, wherein n is 1-6.

22. The method of claim 13, wherein the method separates adjacent lanthanide elements Ln1 and Ln2 with an Ln1/Ln2 selectivity of at least 2.

23. The method of claim 13, wherein the method separates adjacent lanthanide elements Ln1 and Ln2 with an Ln1/Ln2 selectivity of at least 3.

24. The method of claim 13, wherein the method separates Nd and Pr lanthanide elements with an Nd/Pr selectivity of at least 2.

25. The method of claim 13, wherein the method separates Eu and Sm lanthanide elements with an Eu/Sm selectivity of at least 2.

26. The method of claim 13, wherein the method separates Pm and Nd lanthanide elements with an Pm/Nd selectivity of at least 2.

27. The method of claim 13, wherein the method separates Sm and Pm lanthanide elements with an Sm/Pm selectivity of at least 2.

* * * * *